US008482586B1

(12) United States Patent
Martell et al.

(10) Patent No.: US 8,482,586 B1
(45) Date of Patent: Jul. 9, 2013

(54) THERMAL PRINTER OPERABLE TO SELECTIVELY PRINT SUB-BLOCKS OF PRINT DATA AND METHOD

(75) Inventors: Robert W. Martell, Portland, OR (US); Paul D. Scott, Beaverton, OR (US); Giancarlo R. Villanueva, Salem, OR (US); Kevin M. Parks, Portland, OR (US)

(73) Assignee: Graphic Products, Inc., Beaverton, OR (US)

( * ) Notice: Subject to any disclaimer, the term of this patent is extended or adjusted under 35 U.S.C. 154(b) by 0 days.

(21) Appl. No.: 13/366,182

(22) Filed: Feb. 3, 2012

Related U.S. Application Data

(60) Provisional application No. 61/577,550, filed on Dec. 19, 2011.

(51) Int. Cl.
*B41J 2/355* (2006.01)

(52) U.S. Cl.
USPC ..... 347/180

(58) Field of Classification Search
USPC ..... 347/171, 174, 180–182, 190, 191, 347/195
See application file for complete search history.

(56) References Cited

U.S. PATENT DOCUMENTS

| | | | |
|---|---|---|---|
| 3,634,726 | A | 1/1972 | Jay |
| 4,110,810 | A | 8/1978 | Moore et al. |
| 4,214,211 | A | 7/1980 | Yokogawa |
| 4,434,354 | A | 2/1984 | Nakata |
| 4,442,342 | A | 4/1984 | Yoneda |
| 4,494,166 | A | 1/1985 | Billings et al. |
| 4,517,143 | A | 5/1985 | Kisler |
| 4,523,252 | A | 6/1985 | Wallén |
| 4,573,058 | A | 2/1986 | Brooks |
| 4,602,311 | A | 7/1986 | Lloyd et al. |
| 4,707,153 | A | 11/1987 | Nishi et al. |
| 4,717,059 | A | 1/1988 | Takahashi |
| 4,760,492 | A | 7/1988 | Walsh |
| 4,810,432 | A | 3/1989 | Kisler |
| 4,918,464 | A | 4/1990 | Isshiki |
| 4,980,009 | A | 12/1990 | Goodwin et al. |
| 5,084,831 | A | 1/1992 | Morikawa et al. |
| 5,095,400 | A | 3/1992 | Saito |
| 5,132,701 | A | 7/1992 | Stephenson et al. |
| 5,140,341 | A | 8/1992 | Fiscella et al. |
| 5,179,497 | A | 1/1993 | Bakhoum |
| 5,247,420 | A | 9/1993 | Bakhoum |
| 5,280,646 | A | 1/1994 | Koyama et al. |
| 5,321,627 | A | 6/1994 | Reher |
| 5,359,750 | A | 11/1994 | Le Vantine |
| 5,432,533 | A | 7/1995 | Shibamiya |

(Continued)

*Primary Examiner* — Kristal Feggins
(74) *Attorney, Agent, or Firm* — Klarquist Sparkman, LLP

(57) ABSTRACT

An entire block of print data for a message is subdivided into sub-blocks of print data. During printing of sub-blocks, an earlier received sub-block of data is used to print one portion of a substrate moving in the downstream direction. The substrate is moved upstream for a back distance and then moved downstream with the next sub-block of data being printed on the substrate as it is moved downstream. As a back distance section of the substrate again travels in the downstream direction, data from the subsequent sub-block of data that corresponds to data printed on the back distance section of the substrate during printing of the immediately preceding sub-block of data, is printed on the back distance section of the substrate. The sub-blocks of data are in effect stitched together by the dual printed back distance to minimize transition artifacts.

22 Claims, 17 Drawing Sheets

U.S. PATENT DOCUMENTS 5,469,322 A 11/1995 Seo
RE35,214 E 4/1996 McGarry et al.
5,515,087 A 5/1996 Lim et al.
5,551,785 A 9/1996 Mori et al.
5,563,496 A 10/1996 McClure
5,606,242 A 2/1997 Hull et al.
5,606,243 A 2/1997 Sakai et al.
5,611,631 A 3/1997 Ooishi et al.
5,617,324 A 4/1997 Arai
5,659,349 A 8/1997 Albano et al.
5,669,720 A 9/1997 Negishi et al.
5,673,070 A 9/1997 Nakanishi et al.
5,682,504 A 10/1997 Kimura et al.
5,703,469 A 12/1997 Kinoshita
5,719,739 A 2/1998 Horiguchi
5,745,146 A 4/1998 Durst et al.
5,811,890 A 9/1998 Hamamoto
5,835,107 A 11/1998 Suzuki et al.
5,840,452 A 11/1998 Kitagawa
5,844,884 A 12/1998 Szlenski
6,069,709 A * 5/2000 Harrington ..... 347/174
6,095,700 A 8/2000 Negishi et al.
6,120,864 A 9/2000 Chiricosta et al.
6,134,016 A 10/2000 Watanabe et al.
6,167,330 A 12/2000 Linderman
6,169,387 B1 1/2001 Kaib
6,232,747 B1 5/2001 Takahashi et al.
6,247,860 B1 6/2001 Yanagisawa
6,359,419 B1 3/2002 Verbrugge et al.
6,405,012 B2 6/2002 Ishikawa
6,444,102 B1 9/2002 Tucci et al.
6,515,464 B1 2/2003 Darmawaskita et al.
6,532,078 B2 3/2003 Hayama
6,549,947 B1 4/2003 Suzuki
6,647,242 B2 11/2003 Gagnon et al.
6,739,530 B1 5/2004 Shilton et al.
6,784,908 B2 8/2004 Shibuya
6,918,645 B2 7/2005 Takahashi
6,952,555 B2 10/2005 Oh et al.
6,961,075 B2 11/2005 Mindler et al.
7,014,375 B2 3/2006 Nagae et al.
7,052,105 B2 5/2006 Ushigome
7,235,949 B2 6/2007 Ikeda
7,307,592 B2 12/2007 Park et al.
7,330,802 B2 2/2008 Hsu
7,342,381 B2 3/2008 Johnson et al.
7,589,650 B2 9/2009 Hsien et al.
7,696,725 B2 4/2010 Liu et al.
7,711,401 B2 5/2010 Lim
7,768,233 B2 8/2010 Lin et al.
7,812,747 B2 10/2010 Chen
7,924,088 B1 4/2011 Chiang et al.
7,983,863 B2 7/2011 Jin et al.
8,032,040 B2 10/2011 Lee
8,174,549 B2 * 5/2012 Murakami ..... 347/171
2002/0057458 A1 5/2002 Davis et al.
2003/0007180 A1 1/2003 Urasawa et al.
2005/0151831 A1 * 7/2005 Katsuma ..... 347/171
2010/0165406 A1 7/2010 Purnomo

* cited by examiner

THERMAL PRINTER OPERABLE TO SELECTIVELY PRINT SUB-BLOCKS OF PRINT DATA AND METHOD

CROSS REFERENCE TO RELATED APPLICATION

This application claims the benefit of U.S. Provisional Application Ser. No. 61/577,550, entitled THERMAL PRINTER OPERABLE TO SELECTIVELY PRINT SUB-BLOCKS OF PRINT DATA AND METHOD, filed on Dec. 19, 2011, which is incorporated by reference herein.

TECHNICAL FIELD

This disclosure relates to thermal printers for printing a substrate.

SUMMARY

A thermal printer is disclosed for transferring ink, such as from an ink transfer ribbon, to a substrate to print the substrate. The substrate has first and second opposed major surfaces which are movable through the printer in a downstream direction along a print flow path, it being understood that the print flow path need not be straight. A thermal print head in the print flow path is operable to heat the ink transfer ribbon to transfer ink to the substrate at a print location as the ink transfer ribbon and substrate travel relative to the thermal print head along the print flow path. In accordance with an aspect of this disclosure, print data for a message to be printed on the substrate can be subdivided from a block of print data containing the data for the entire message to be printed on the substrate into sub-blocks of data. Subdivision of the print data into sub-blocks can, for example, be accomplished in the event the capacity of a thermal print head memory that stores data for printing by the thermal print head would be exceeded if the entire block of print data were delivered to the print head memory. During printing of the sub-blocks of print data, one sub-block of print data is used to print one portion of the substrate moving in the downstream direction. The substrate is then moved upstream for a back distance and then again moved downstream. The next sub-block of print data is then printed on the substrate as it is moved downstream. The print data in this next sub-block that is printed on the back distance portion of the substrate corresponds to the print data printed on the back distance portion of the substrate during the printing of the preceding sub-block of print data. As a result, the sub-blocks of print data are in effect stitched together by the dual printed back distance to thereby minimize transition artifacts in the printed message that is printed on the substrate in response to the two successive sub-blocks of data. In addition, the print head can be allowed to cool during the time that the substrate is moved the back distance in the upstream direction to thereby reduce the presence of printing artifacts in the printing region that can arise from an overheated print head.

In an aspect of an embodiment in which the substrate comprises a coil of substrate that is unrolled with an unrolled portion passing the thermal print head and an unrolled portion of a coiled thermal print ribbon also passing the thermal print head, the ribbon and substrate can be moved together in their respective upstream and downstream directions. A motor can be used to move the substrate in the respective upstream and downstream directions. In addition, the same or a different motor can be used to move the ribbon in the downstream direction. In addition, a tensioning mechanism, such as a clutch mechanism coupled to a supply roll of thermal print ribbon, can apply back tension to the thermal print ribbon to move the thermal print ribbon in the upstream direction as the substrate is moved in the upstream direction. A cutter can be operated to sever the substrate following the printing of the entire message.

In accordance with an embodiment of a thermal printing method, the method can comprise moving a first portion of a substrate to be printed in a first direction past a thermal print head; printing the first portion of the substrate passing the thermal print head in the first direction with a first sub-block of data of a block of data during a first printing act; and interrupting the printing of the substrate by the thermal print head following printing of the first sub-block of data and reversing the direction of movement of the substrate such that a back distance section of the first portion of the substrate passes the thermal print head in a second direction opposite to the first direction. The method can further comprise moving a second portion of the substrate that includes the back distance section in the first direction past the thermal print head such that the back distance section of the substrate again passes the thermal print head in the first direction; and printing the second portion of the substrate passing the thermal print head in the first direction with a second sub-block of data during a second printing act, the portion of the second sub-block of data printed on the back distance section of the substrate during the second printing act corresponding to the data printed on the back distance section of the substrate during the first printing act.

As another aspect of the above method, the length of the substrate to be printed with the block of data can be compared to a maximum unsubdivided length, and, if the length exceeds the maximum unsubdivided length, subdividing the block of data into plural sub-blocks of data for thermal printing on portions of the substrate that are each less than the maximum length, and repeating the acts so as to print each sub-block of data onto an associated portion of the substrate.

As a further aspect of the method, the act of subdividing the data can comprise subdividing the data into sub-blocks of data for printing on equal or variable length portions of the substrate. The portions of the substrate can, in one desirable embodiment, be between four and six inches.

As another aspect of an embodiment, the act of reversing the direction of movement can comprise reversing the direction of movement by a back distance section that is a predetermined number of pixels long. The predetermined number of pixels can be from 15 to 25 pixels. Alternatively, the act of reversing the direction of movement can comprise reversing the direction by a back distant section that is of a desired distance, such as 1.5 mm.

In accordance with an embodiment, the thermal print head can have a print head driver memory of a first size, the sub-blocks of data are no greater in size than can be received and stored at one time in the print head driver memory, and a printing method can comprise delivering a successive sub-block of data to the print head driver memory following the printing of a portion of the substrate by the thermal print head with a sub-block of data stored in the print head driver memory. The printing acts of this method can comprise printing the substrate from a thermal print ribbon, moving the thermal print ribbon in a first downstream direction past the thermal print head with the moving of substrate in the first direction, and the act of applying back tension to the print ribbon to move the ribbon in a second upstream direction past the print head as the substrate is moved in a second upstream direction through a back distance. Also, the acts of moving first and second portions of a substrate can comprise moving portions of a substrate from an elongated coil of substrate, the method comprising determining a length of substrate required to print the entire block of data and following the printing of the last sub-block of successive sub-blocks of data making up the block of data, severing the printed portions of the substrate containing the entire block of data from the coil of substrate.

As another embodiment, a thermal printing method for printing a substrate from a thermal print ribbon in response to print data comprises: subdividing a block of data to be printed by a thermal print head of a thermal printer onto a length of substrate into N data sub-blocks, N being greater than one with the sub-blocks to be printed in order from the first sub-block to the $N^{th}$ sub-block, each sub-block to be printed on an associated portion of the substrate with the first sub-block printed on a first portion of the substrate, the second sub-block printed on a second portion of the substrate through and including the $N^{th}$ sub-block printed on the $N^{th}$ portion of the substrate; a. moving a first portion of the substrate in a first direction past the thermal print head; b. printing the first portion of the substrate passing the thermal print head in the first direction with the first sub-block of data during a first printing act; c. interrupting the printing of the substrate by the thermal print head following printing of the first sub-block of data and reversing the direction of movement of the substrate such that a back distance section of the first portion of the substrate passes the thermal print head in a second direction opposite to the first direction; d. moving a second portion of the substrate that includes the back distance section in the first direction past the thermal print head such that the back distance section of the substrate again passes the thermal print head in the first direction; e. printing the second portion of the substrate passing the thermal print head in the first direction with the second of the sub-blocks of data during a second printing act, the portion of the second sub-block of data printed on the back distance section of the substrate during the second printing act corresponding to the data printed on the back distance section of the substrate during the first printing act; f. repeating the steps a through c for each succeeding portion of the substrate from the third substrate through the $N-1^{th}$ substrate with the third sub-block of data being printed on the third portion of the substrate through and including the $N-1^{th}$ sub-block of data being printed on the $N-1^{th}$ portion of the substrate; g. moving the $N^{th}$ portion of the substrate that includes the back distance section in the $N-1^{th}$ portion of the substrate in the first direction past the thermal print head such that the back distance section of the $N-1^{th}$ portion of the substrate again passes the thermal print head in the first direction; printing the $N^{th}$ sub-block of data on the $N^{th}$ portion of the substrate passing the thermal print head in the first direction during an $N^{th}$ printing act, the portion of the $N^{th}$ sub-block of data printed on the back distance section of the substrate during the $N^{th}$ printing step corresponding to the data printed on the back distance section of the substrate during the $N-1^{th}$ printing act; and severing the substrate from the substrate coil following the printing of the $N^{th}$ sub-block of data.

As a further embodiment, a thermal printer for printing a substrate from a thermal print ribbon in response to print data comprises: a substrate holder for supporting a coil of substrate; a thermal print ribbon holder for supporting a coil of thermal print ribbon; a thermal print head in a print flow path; a platen rotatable in respective opposite first and second directions and positioned adjacent the thermal print head, the platen engaging the substrate from the roll of substrate and advancing the substrate in the print flow path in a first downstream direction past the thermal print head upon rotation of the platen in the first direction and reversing the direction of movement of the substrate to move the substrate in a second upstream direction opposite to the first direction upon rotation of the platen in the second direction; a substrate drive motor coupled to the platen and operable to rotate the platen in the respective first and second directions; a ribbon take-up positioned to take up ribbon at a ribbon take-up location of the ribbon downstream in the first direction from the thermal print head; a ribbon drive motor coupled to the ribbon take-up and operable to rotate in a direction to move the ribbon downstream in the first direction with the movement of the substrate in the first downstream direction, the ribbon holder comprising a clutch operable to apply tension to the thermal ribbon to move the thermal ribbon in the second upstream direction with the movement of the substrate in the second upstream direction upon rotation of the platen in the second direction; and a cutter operable to sever a length of the substrate from the coil of substrate following printing of the substrate with an entire block of data, the cutter being located to sever the substrate at a location downstream in the print flow path from the thermal print head.

In this embodiment, a printer controller can comprise a first memory for storing a block of print data corresponding to an entire message to be printed on the length of the substrate to be severed from the coil of substrate following printing of the block of print data; and a print head controller can comprise a print driver memory, coupled to the first memory and to the thermal print head, the print head memory receiving print data from the first memory and the print head controller controlling the printing by the thermal print head to print the substrate traveling in the first upstream direction with a message corresponding to the received print data. As an aspect of this embodiment, the printer controller can be operable to deliver the entire block of print data to the print head memory in the event the entire block of print data is smaller than the storage capacity of the print head memory; the printer controller can also be operable to subdivide the block of print data into a plurality of data sub-blocks of print data at least if the block of print data exceeds the storage capacity of the print head memory; and, in the event the print data is subdivided into a plurality of print data sub-blocks, the printer controller can be operable to control the substrate drive motor and the ribbon drive motor to cause movement of a first portion of the substrate in a first direction past the thermal print head. The print head controller can also be operable to control the thermal print head to print the first portion of the substrate passing the thermal print head in the first direction with a first sub-block of print data during a first printing act, and to interrupt the printing of the substrate by the thermal print head following printing of the first sub-block of print data. In addition, the printer controller can be operable to control the substrate drive motor to reverse the direction of movement of the substrate such that a back distance section of the first portion of the substrate passes the thermal print head in the second downstream direction, and to thereafter move a second portion of the substrate that includes the back distance section in the first upstream direction past the thermal print head such that the back distance section of the substrate again passes the thermal print head in the first direction. In addition, the print head controller can be operable to control the thermal print head to print the second portion of the substrate passing the thermal print head in the first downstream direction with a second sub-block of print data during a second printing act, the portion of the second sub-block of print data printed on the back distance section of the substrate during the second printing act corresponding to the print data printed on the back distance section of the substrate during the first printing act, the printer controller and print head controller controlling the repeat of these acts until the entire block of print data is printed onto the substrate; and the printer controller also being coupled to the cutter to control the cutter to sever the substrate following printing of the entire block of print data onto the substrate.

As an aspect of an embodiment, the substrate drive motor and the ribbon drive motor can be a single motor.

These and other novel and non-obvious features and method acts will become more apparent from the description below and the drawings. The present invention encompasses all such novel and non-obvious method acts and features individually, as well as in combinations and sub-combinations with one another.

DETAILED DESCRIPTION

Figure 1:
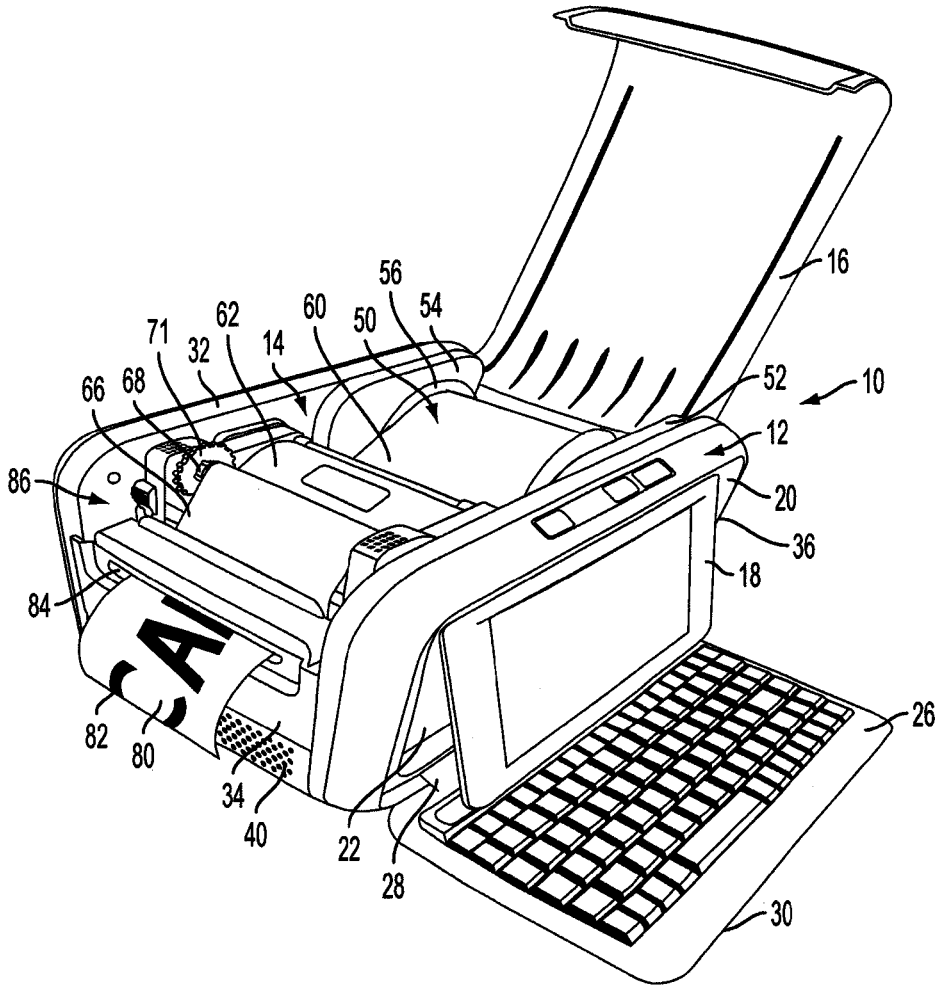
FIG. 1 is a perspective view of one embodiment of a thermal printer that is open to show selected components of the printer. The FIG. 1 embodiment illustrates a thermal printer with numerous ornamental features that can be modified without interfering with the functionality of the printer.
Figure 2:
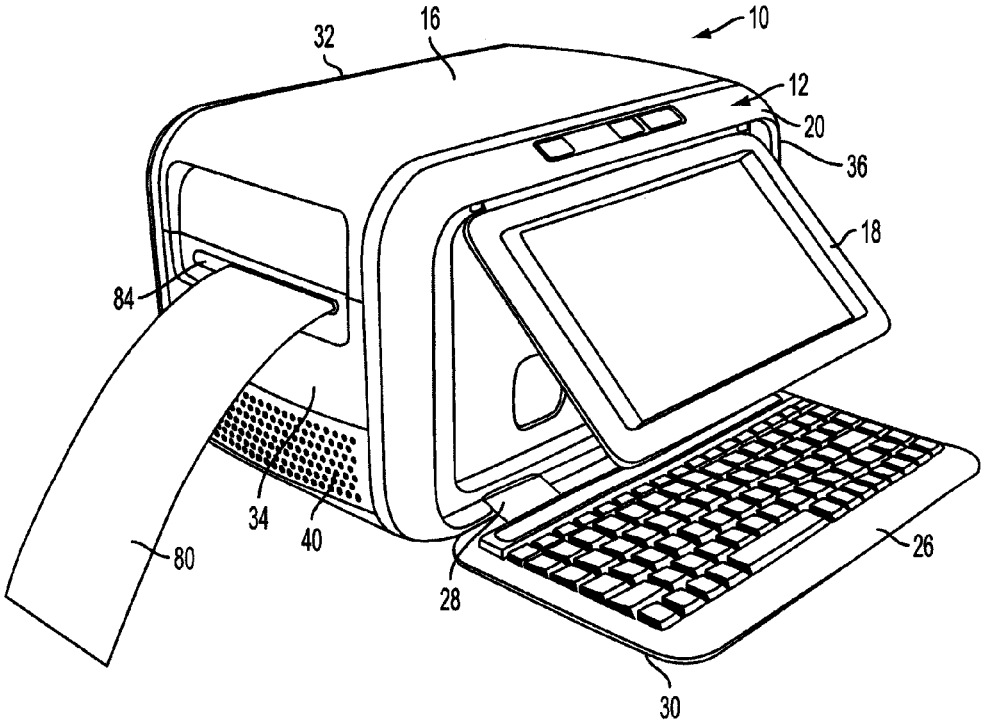
FIG. 2 is a perspective view of a thermal printer in accordance with FIG. 1 that is closed.
Figure 3:
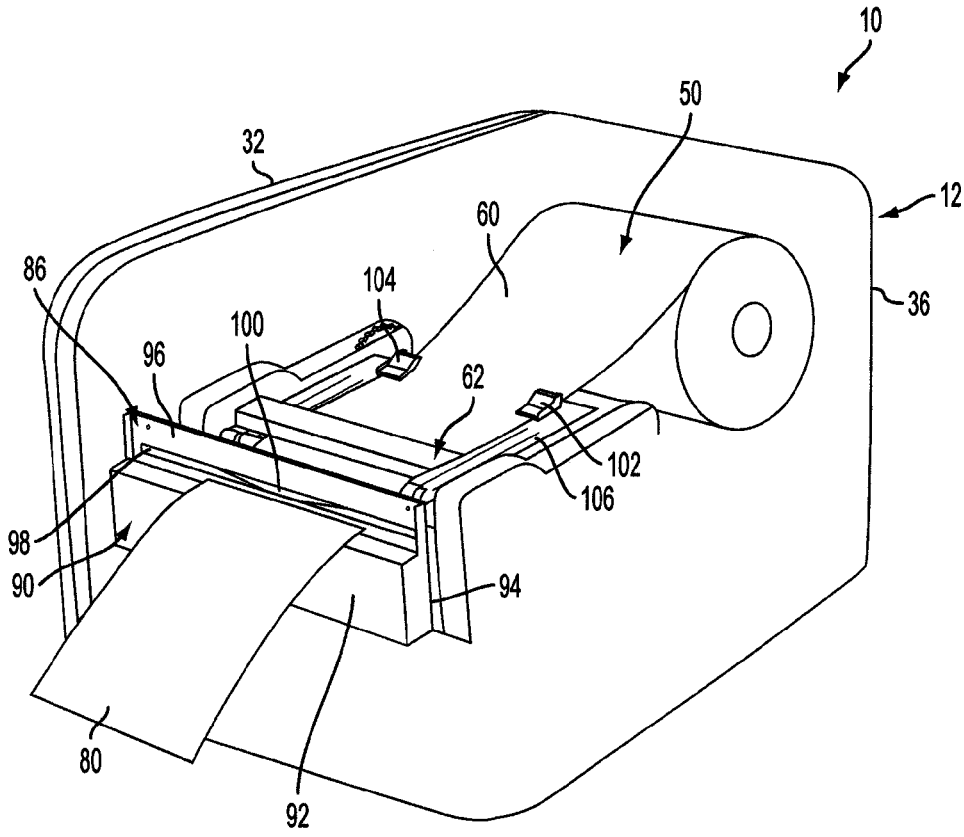
FIG. 3 is a partially broken away view of the printer of FIG. 1 with some components removed for convenience.

With reference to FIGS. 1-3, an exemplary thermal printer 10 comprises a housing 12 having an upwardly opening internal chamber 14 that is selectively closable by a cover 16 that can be pivoted to the housing. A display, such as a screen 18 is included in the illustrated printer. The display is shown positioned along a side wall 20 of the printer housing 12. Side wall 20 can include a recess 22 sized to receive the display when the display is moved from a deployed position as shown in FIG. 1, wherein the display is angled outwardly from side wall 20 from an upper portion of the recess 22, to a stowed position, wherein the display is positioned within the recess 22. The display 18 can be hinged or otherwise pivoted to the housing such as along its upper edge.

A data input device, which can take any suitable form, such as a keyboard, touch screen, or other data input is shown in FIG. 1. In FIG. 1, the data input device comprises a keyboard 26 that can be used, for example, to enter lettering or other messages to be printed by the printer onto print substrate as explained below. The keyboard 26 can be pivoted to the housing, such as by first and second hinges, one being indicated by the number 28 in FIG. 1, for pivoting about a pivot axis from a deployed position, such as shown in FIG. 1, to a stowed position wherein the keyboard is positioned against side wall 20 to thereby protect the keyboard and screen 18. In this example, the hinge 28 and a companion hinge allow pivoting of keyboard 26 about a longitudinally extending axis adjacent to a lower bottom edge of side wall 20. The axis about which keyboard 26 pivots can be parallel to and spaced from the axis about which screen 18 pivots. The bottom surface 30 of keyboard 26 can comprise a durable material, such as a relatively hard polymer or plastic to provide protection to the internal components when the display 18 and keyboard 26 are stowed.

The housing 12 also can comprise a durable material such as polymer or plastic. In addition to side wall 20, the illustrated housing 12 comprises an opposed side wall 32 spaced transversely from side wall 20 and first and second end walls 34, 36. Although not shown in FIG. 1, side wall 32 can comprise a recess for receiving a rechargeable battery that is the sole power source for the printer at least when the printer is not at a location where it can be plugged into a battery charger or other power source. In one desirable embodiment, the battery is the sole power source for the printer and must be removed for recharging. End wall 34 is provided with ventilation apertures 40 communicating with the interior of chamber 14 through which heat from the printer can dissipate.

In the thermal printer of FIGS. 1-3, substrate to be printed is moved through the printer along a print flow path. The thermal printable substrate can take any number of forms. For example, the substrate can comprise thermoplastic polymer films, sheets or fabrics. In one specific example, the substrate can comprise a multi-layered material, such as a plurality of thermoplastic layers of high density polyethylene (HDPE) that has been extruded, stretched, bias-cut and cross laminated into a composite structure that can comprise, for example, between thirteen and fifteen layers. Vinyl is another example of a suitable substrate. This disclosure is not dependent upon the type of substrate that is used.

A thermal ink transfer ribbon is sandwiched with the substrate and moved relative to a thermal print head along the print flow path into contact with the print head. Thermal ink transfer ribbons are of varying constructions. In one specific example, the ink transfer ribbon comprises an ink carrier or backing ribbon of polyester with an ink coating on a first side of the backing ribbon that faces the printing substrate and is on the opposite side of the backing ribbon from a thermal print head. The second side of the ribbon, opposite to the first side and facing the thermal print head conventionally can be coated with a friction and static reducing back coat material to facilitate sliding of the ribbon across the surface of the thermal print head during printing. The ink coating will release from the carrier when heated to heat transfer the ink to the printing substrate. The operation of the thermal print head is controlled in a conventional manner to selectively heat the print head (e.g. individual pixels of the print head being heated as required to transfer portions of the ink from the ink transfer ribbon) to cause the transfer of ink from the ink transfer ribbon to the adjacent surface of the print substrate in the desired pattern to be printed thereon. The ink transfer ribbon is then separated from the substrate with the printed substrate exiting the printer. In the case of a continuous roll form substrate, a cutter can be included in the print flow path for cutting or separating pieces of the substrate, such as labels, following printing.

With reference to FIGS. 1 and 3, and keeping in mind that the disclosure is not limited to the use of roll form substrates or roll form ink transfer ribbons, a roll of substrate 50 is shown positioned within the housing 12. The substrate roll can be supported by a rod or axle coupled to the respective side walls 20, 32 of the housing, such as to interior wall portions 52, 54 that project inwardly from the respective side walls 20, 32. The substrate roll 50 is supported for pivoting about a transverse axis such as about an axis that is perpendicular to the longitudinal axis of the printer and to the direction of travel of the substrate. The substrate roll 50 can be supported by a reel 56, or a core not shown, on a pin or rod extending between wall portions 52, 54 (or between spool or core holders projecting outwardly from the opposed wall portions) so as to allow the roll to rotate about the support axis to unroll substrate from the substrate roll during printing. The supporting axle, rod or core can be rotatably coupled to side wall portions 52, 54 or the core or spool 56 can be rotatable about a fixed rod.

FIG. 1 shows a portion 60 of substrate being fed from roll 50 to the underside of a thermal print head 62 coupled to the housing 12. A roll 61 of ink transfer ribbon, that can be rotatably supported in the same manner as substrate roll 50, is positioned within chamber 14 of housing 12 for supplying the ink transfer ribbon 63 to be used in the printing operation (this ink ribbon supply roll 61 is not shown in FIG. 1 for convenience, but is shown as ink transfer ribbon roll 61 in FIG. 5). The roll of ink transfer ribbon can be supported for rotation about a transverse axis parallel to the axis of rotation of substrate roll 50 for rotation about a transverse axis extending between wall portions 52 and 54. The ink transfer ribbon is positioned in contact with one major surface of the substrate and a sandwich of ink transfer ribbon and substrate is moved in contact with the thermal print head with the print head heating the ink transfer ribbon to transfer the desired print pattern to the major surface of the substrate. The substrate as shown in FIG. 1 has an upper major surface and a lower major surface, as well as side edges. The upper major surface is visible in FIG. 1.

In FIG. 1, used ink transfer ribbon 66 is separated from the substrate at a location downstream from the location where printing occurs (where the ink transfer ribbon is heated). The used ink transfer ribbon is wound as a roll 70 onto a rod 68 of an ink transfer ribbon take up mechanism. The ink transfer ribbon take-up rod, axle or core can be driven, such as via an electric motor and a drive gear 71 to take up the slack in the ink transfer ribbon as the ribbon exits from contact with the thermal print head. The printed substrate 80, with printing 82 thereon, exits from the printer via a slot 84 in the end wall 34. In the case of continuous roll form substrates, a cutter, indicated generally at 86, can be included and operated to cut the substrate at a desired location to sever the printed substrate from the remainder of the substrate roll. For example, in the case of a label printer, the substrate can be severed following the printing of each label. Alternatively, the labels can be manually separated following printing.

FIG. 3 illustrates one form of a suitable cutter in greater detail. The illustrated form of cutter 86 comprises a housing 90 having a front wall 92 and a rear wall 94. A portion 96 of the rear wall projects upwardly from the main body of the housing 92. A slot 98 extends through rear wall 96. The slot is positioned in the print flow path downstream from the thermal print head such that the substrate is guided through the slot toward the exit slot 84 from the printer housing. A blade 100 is reciprocated to cut the substrate and sever the printed substrate 80 from the roll 50.

Figure 5:
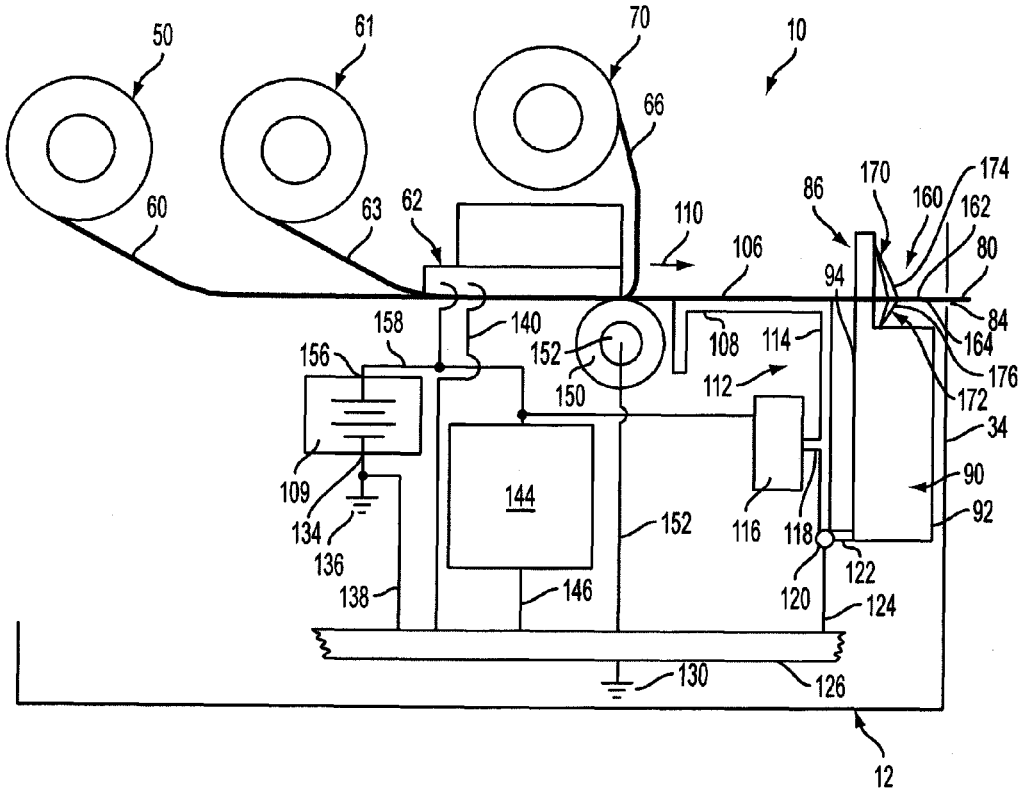
FIG. 5 is a side elevational view of an embodiment of a thermal printer that schematically illustrates a number of components of the printer.

In FIG. 3, the substrate material 60 leaving the substrate roll 50 is guided by spaced apart guides 102, 104 that engage the upper major surface and side edges of the substrate. The side to side spacing of the guides 102, 104 can be varied to accommodate substrates of different widths. The lower major surface of the substrate is supported by support surface 106, such as a planar upper surface of a support 108 (see FIG. 5). As shown in FIG. 5, the support portion 108 can be a support plate portion with surface 106 positioned in the print flow path to provide support for the lower major surface of the substrate as it moves in the print flow path, such as in the downstream direction indicated by arrow 110 in FIG. 5. The support portion 108 can comprise an extension portion of a support bracket 112 and more specifically a projecting portion extending from the upper end of an upwardly extending portion 114 of the bracket 112. The bracket 112 is coupled to the housing 12. A cutter control circuit board 116 that provides control signals to the cutter to cause cutting of the substrate can also be supported by the support bracket 112, such as by a circuit board supporting extension portion 118 extending from the bracket portion 114 of the bracket 112. A pivot, such as a hinge 120 can be provided at a lower portion of the support portion 114. The housing 90 of the cutter 86 can be coupled by pivot 120 for pivoting about a transverse axis through the pivot 120, the transverse axis desirably being perpendicular to the direction 110 of substrate travel. The bracket 112 desirably comprises a cutter support portion 122, that extends from pivot 120 and supports the cutter housing 90. With this construction, the cutter housing can be pivoted (together with the support bracket 112) to provide access to the interior of the printer.

The bracket 112, pivot 120 and pivot extension 122, as well as the cutter housing 90, can all be of or comprise an electrically conductive material. The bracket can be electrically coupled, such as indicated schematically by a conductor 124 to an electrically conductive portion 126 of a chassis frame of the printer and an internal ground 130 of the printer. A battery 109 that can provide power to the printer has an anode 134 corresponding to a battery ground 136 which is shown schematically coupled to the chassis or frame portion 126 such that the battery ground 136 corresponds to the internal ground 130 of the printer. The electrical connection of the battery ground 136 to the internal ground 130 is indicated schematically by the conductor 138 in FIG. 5. The thermal print head 62 can also be electrically coupled, such as indicated schematically by conductor 140, to the internal ground. In addition, a main circuit board 144, can also be electrically coupled, such as by a schematically indicated conductor 146 to the internal ground. The main circuit board in this embodiment provides control signals to cutter circuit board 116, controls the operation of the thermal print head 62, and receives inputs from the input device such as keyboard 26 (FIG. 1).

Although various mechanisms can be used for advancing a sandwich of substrate and ink transfer ribbon through the printer along the print flow path, in FIG. 5 a platen roller 150 is shown for this purpose. Roller 150 is driven by rotating the roller to move the substrate and ink transfer ribbon through the printer, such as in the direction of arrow 110. The platen can also be operated to reverse the direction of rotation of the platen if desired. The roller 150 can comprise a roller with a polymer exterior surface and can comprise rubber. The illustrated roller backs up the lower major surface of the substrate at or adjacent to the location where printing takes place. The platen can be drivenly supported by an axle or rod 152 that can comprise an electrically conductive material coupled to the internal ground. This coupling is represented schematically by a conductor 152 shown connecting the axle 152 to the frame portion 126 and thus to the internal ground 130. The cathode 156 of the battery 132 is shown schematically coupled to the thermal print head 62, the main circuit board 144 and to the cutter circuit board 116 by conductors collectively indicated by the number 158. Other powered components of the printer, such as a driver for platen 152 and the take up 170 also can be electrically coupled to the battery by electrical conductors that are not shown. FIG. 5 also illustrates a roll of ink transfer ribbon 61 on an ink transfer ribbon support 63.

During printing by a thermal printer, particularly one powered solely by a battery, static electricity can build up on the surfaces of the substrate, such as on the upper and lower major surfaces of the substrate in FIG. 5. Certain types of substrates are more prone to higher levels of static build up. The static electricity build up is particularly pronounced when certain types of substrates, such as vinyl, move through the print head and are printed thereon. In the case of a rolled substrate, the source of static electricity is not entirely clear. However, the static electricity may arise from unrolling of the substrate, from unrolling an ink transfer ribbon that is placed in contact with the substrate to form a sandwich of the ink transfer ribbon and substrate as it passes the thermal print head, from printing by the thermal print head and/or from the separation of the ink transfer ribbon from the sandwich following printing and prior to discharge of the printed substrate from the printer. Regardless of the source of the static electricity, it is possible for a charge in excess of 20 kilovolts to develop in the printer operated to continuously permit a roll of thirty feet of vinyl substrate. A static buildup of this magnitude, or a somewhat lower magnitude, if discharged in an uncontrolled manner, can damage printer circuitry. It is desirable that the static electricity be completely discharged from the printed substrate, although a discharge to a potential below about 8 kilovolts minimizes or eliminates the risk of damage to the printer from the static electricity. To reduce this build up to a level that is sufficiently low so as to prevent this damage, for example to a range of between positive or negative 8 kilovolts, an electrical static discharge mechanism can optionally be included in embodiments of a thermal printer disclosed herein.

Figure 4:
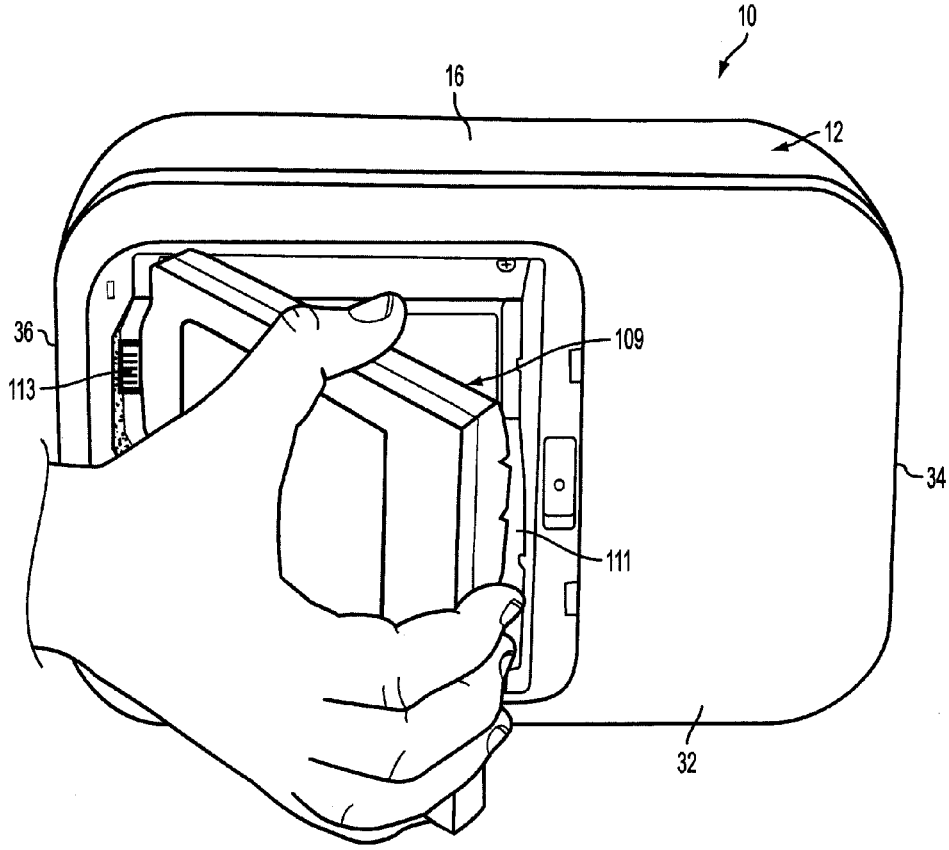
FIG. 4 is a perspective view of an exemplary thermal printer illustrating the insertion of a battery for powering the printer, into a battery receiving compartment of the printer housing.

FIG. 4 illustrates an exemplary printer looking toward side wall 32 thereof. Side wall 32 is provided with a recess or pocket 111 sized to receive a battery 109 inserted therein with terminals of the battery (anode and cathode terminals) connected to electrical contacts of circuitry within the printer, with one such contact being indicated at 113 in FIG. 4. The battery can be inserted and removed from the pocket 111 for recharging or replacement as needed. The battery 109 can comprise any suitable portable power source, such as a lithium or metal hydride battery, or a fuel cell electrical power supply.

When the printer is being operated in a stand alone mode of operation powered solely by power from a battery 109, the internal electrical ground 130 is the only electrical ground for the printer as the printer is not connected to a power grid and thus is not connected to the external electrical ground of the power grid. If the battery is being charged by a battery charger from the electrical grid, such as from an A/C to D/C converter coupled to the grid, the internal electrical ground can be connected to the grid ground with power for the printer being available from the battery. In this case, as an alternative, the power can be supplied from the A/C to D/C converter output or from the battery output, whichever is at the highest potential. As another alternative, the printer can be powered solely by the battery, with the battery being required to be removed from the printer for recharging. In this latter example, the only effective electrical ground for the printer is the internal electrical ground. Some printer embodiments can be powered by a connection to the electricity grid, such as to an alternating current power source and electrically grounded via a ground of the power supply, which reduces static electricity buildup without the use of one or more static electricity dischargers, although it/they can be included.

Figure 4A:
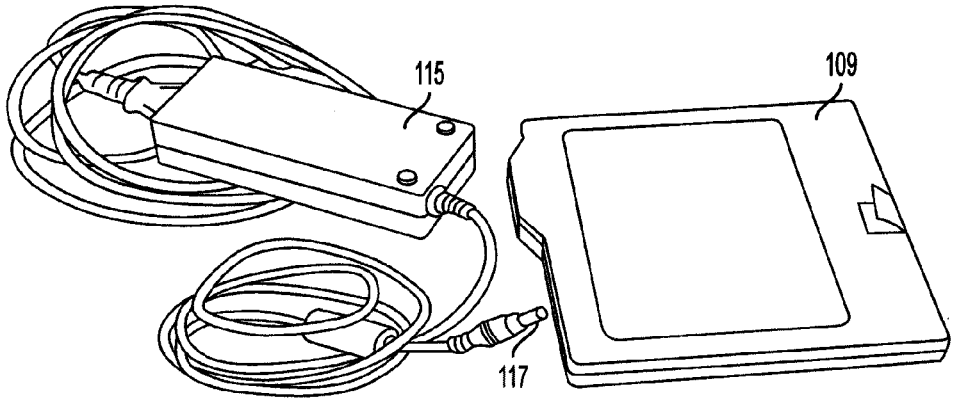
FIG. 4A is a perspective view of a battery that can be used in the printer of FIG. 1 for providing electrical power to the printer, together with a charger that can be used to charge the battery.

FIG. 4A illustrates the battery 109 removed from the printer housing 12. A battery charger 115 having a charging connecting 117 for coupling to a charging input port of battery 109 is shown. The battery charger can be plugged into a standard A/C outlet to provide charging power to the battery. Alternatively, a vehicle charger can be used. The battery can be configured with a charging input that allows charging of the battery without removal of the battery from the thermal printer.

With further reference to FIG. 5, a static discharge mechanism 160 can be provided to discharge (which includes neutralizing) static charge on the major surfaces 162, 164 of the substrate between the side edges thereof that would otherwise develop during printing. During such printing, typically a positive static electricity charge would otherwise build up on these surfaces.

Such a static discharge mechanism can comprise at least one static electricity discharger positioned to engage at least one of the first and second major surfaces 162, 164 to sweep or discharge static electricity from the engaged major surface or surfaces. It has been found that discharging of some static electricity charge occurs if only one of the major surfaces is engaged by a static electricity discharger. However, a more complete discharge of static electricity takes place if a first static electric discharger engages one of the major surfaces and a second electric static discharger engages the other of the major surfaces.

The other aspects of this disclosure can be alternatively included in embodiments without a static discharge mechanism.

Figure 6:
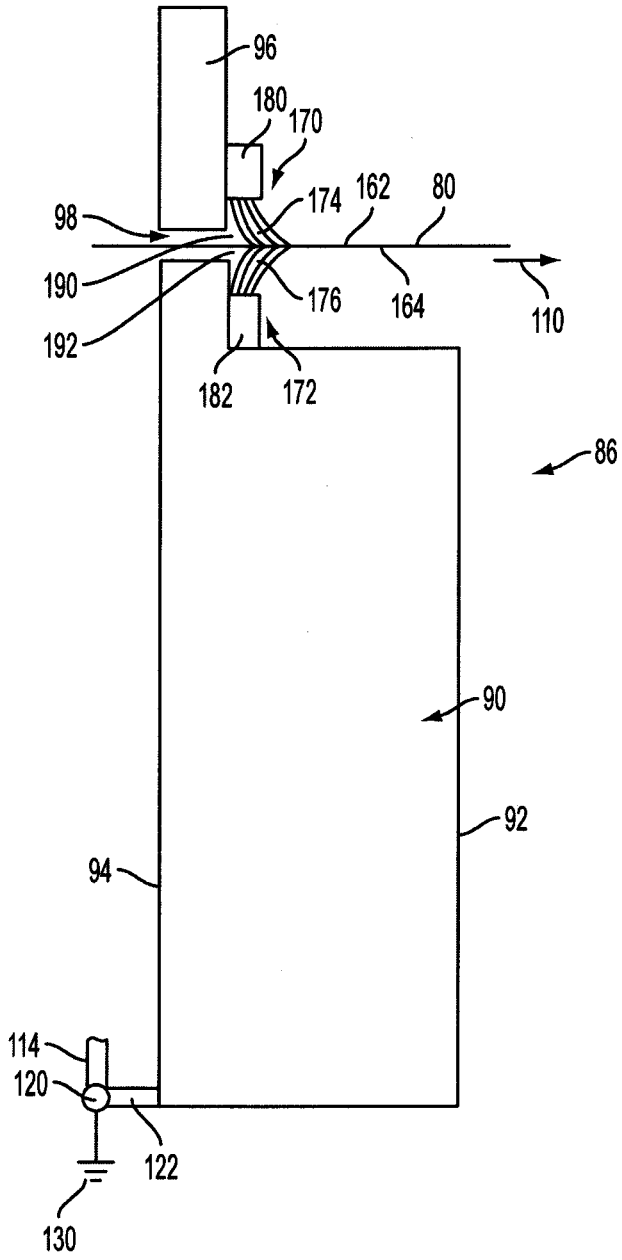
FIG. 6 is a schematic side elevational view of a cutter that can be included in a printer for separating the substrate into pieces, such as separating a printed label from remaining portions of the substrate.

The static electric dischargers, if included, can each comprise an electrically conductive static electricity discharge element that contacts a respective major surface of the substrate and that is electrically coupled to the internal ground. In one specific example, the discharge elements can comprise one or more brushes, such as two brushes 170, 172 shown in FIG. 5. The brush or brushes 170 can comprise a plurality of electrically conductive bristles 174 that contact the upper major surface 162 of the substrate 80. In addition, the one or more brushes 172 can comprise a plurality of bristles 176 in contact with the lower major surface 164 of the substrate 80. The static electric discharge members can desirably be positioned downstream from the print location where ink is transferred from the ribbon to the substrate. In FIG. 5, the brush type electric discharge members 170, 172 are positioned such that the bristles engage the respective major surfaces 162, 164 of the substrate at a location downstream from the cutter 86 that cuts the substrate from the roll. Alternatively, the brush type electric discharge elements can be mounted to the opposite side of the cutter to position the bristles at a location upstream from the cutter. In addition, as another alternative, the brushes can be supported at locations spaced from the cutter, either upstream (between the print location and the cutter) or downstream from the cutter. As can be seen in FIG. 6, these static electricity discharge elements can comprise a base, for example base 180 for discharger 170 and base 182 for discharger 172. Base 180 supports bristles 174 so as to project outwardly from the base and toward the associated major surface 162 with tip portions of the bristles 174 contacting the surface 162. Similarly, bristles 176 are supported by base 182 so as to project outwardly from the base toward the major surface 164 of the substrate with tip portions of the bristles 176 contacting the major surface 164. As the substrate 80 travels in the direction 110, the bristles of the embodiment shown in FIG. 6 have sufficient flexibility so as to bend as shown with the tips of the bristles engaged by the substrate surfaces moving in a downstream direction. In this example, an acute angle 190 exists between tip portions of the bristles 174 and the upper surface 162 and a similar acute angle 192 exists between the tip portions of bristles 176 and the contacted surface 164.

The bristles 174, 176, if included, are desirably comprised of electrically conductive materials. In addition, in this example, the respective bases 180, 182 can also be comprised of electrically conductive materials. In this example, with a cutter housing 90 comprising electrically conductive materials, an electrically conductive flow path is provided from the surfaces of the substrate via the respective bristles and bases and the cutter housing and the support 122 to the internal ground 130. As a result, the static electric charge is in effect coupled to ground and discharged or neutralized from the surfaces 162, 164 of the substrate to a sufficient level (e.g., less than 8 kilovolts) so as not to risk damage to printer electronic components. The electric discharge members, such as bristles 174, 176 can be coupled to the internal ground other than through the cutter housing.

Desirably, the electrical resistance between the tips of the bristles and the internal ground is less than about 200 ohms. Although other materials can be used for the bristles 174, 176, one specific exemplary material comprises carbon fiber brush hairs having a diameter of approximately 0.01 mm and a length of approximately 8.26 mm. These hairs can be provided at a density of, for example, about 10,000 hairs per lineal inch of base. Alternatively, the bristles can be provided in the form of tufts or bunches of bristles mounted to the base at spaced locations along the base with, for example, a spacing of approximately 5 mm per tuft and 1500 bristles per tuft. The length of the bases and brushes can be varied. For example, a length of about 4.25 inches can be used for printing labels of a width (in a direction transverse to the direction of 110) that is about 4.25 inches, although static electric discharge will also take place if a substrate has a width that is narrower or wider than the width of the brushes. It is however desirable that, if included, the brushes be at least within 80 percent of the overall width of the substrate. The brushes are desirably positioned and supported such that the bristles lightly contact the upper and lower surfaces of the substrate.

It should be noted that the bristles can be of other materials, such as copper, although copper bristles have been found to be less effective than carbon bristles. In addition, stainless steel bristles, although suitable to discharge some static electricity, can mar the surface of the substrate because of the hardness of the stainless steel. As another alternative, the electrically conductive elements can be electrically conductive fabric, such as comprised of woven carbon or other electrically conductive materials, such as in sheet form. Static electricity dischargers comprising bristles as the discharge elements are particularly desirable.

Desirably, the static electricity dischargers, if included, do not require electric power to operate to discharge static electricity. Thus, these passive static electricity dischargers do not suffer from the drawback of requiring electrical power to operate which would shorten the length of time the printer can be used between battery recharges.

Figure 7:
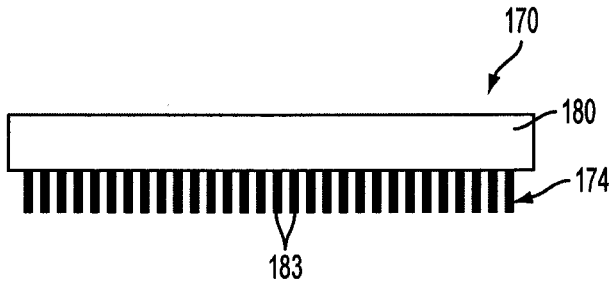
FIG. 7 is a front elevational view of one form of a static electricity discharge member that can be included to discharge static electricity from the substrate.

FIG. 7 illustrates one exemplary form of a brush type electrical discharge member 170 having an elongated base 180 and a plurality of bristles 176. The bristles 176 are shown in the embodiment of FIG. 7 in the form of tufts of plural bristles, some of these tufts being indicated by the number 183 in this figure.

FIGS. 8-11 illustrate an exemplary drive mechanism usable to move the substrate and ink transfer ribbon along the printer flow path. Although separate motors can be used to move the transfer ribbon and the substrate, in the embodiment shown in these figures, a single motor is used for this purpose. The motor is coupled in this example, by gears to the substrate and ink transfer ribbon support mechanisms. The drive mechanism illustrated in this embodiment is operable to not only move the ink transfer ribbon and substrate in a downstream direction along the print flow path, but also is operable to selectively reverse the direction of movement to move the ink transfer ribbon and substrate in an upstream direction. The upstream movement is desirably used to establish the transition region or back distance for printing between respective successive sub-blocks of print data being printed.

Figure 8:
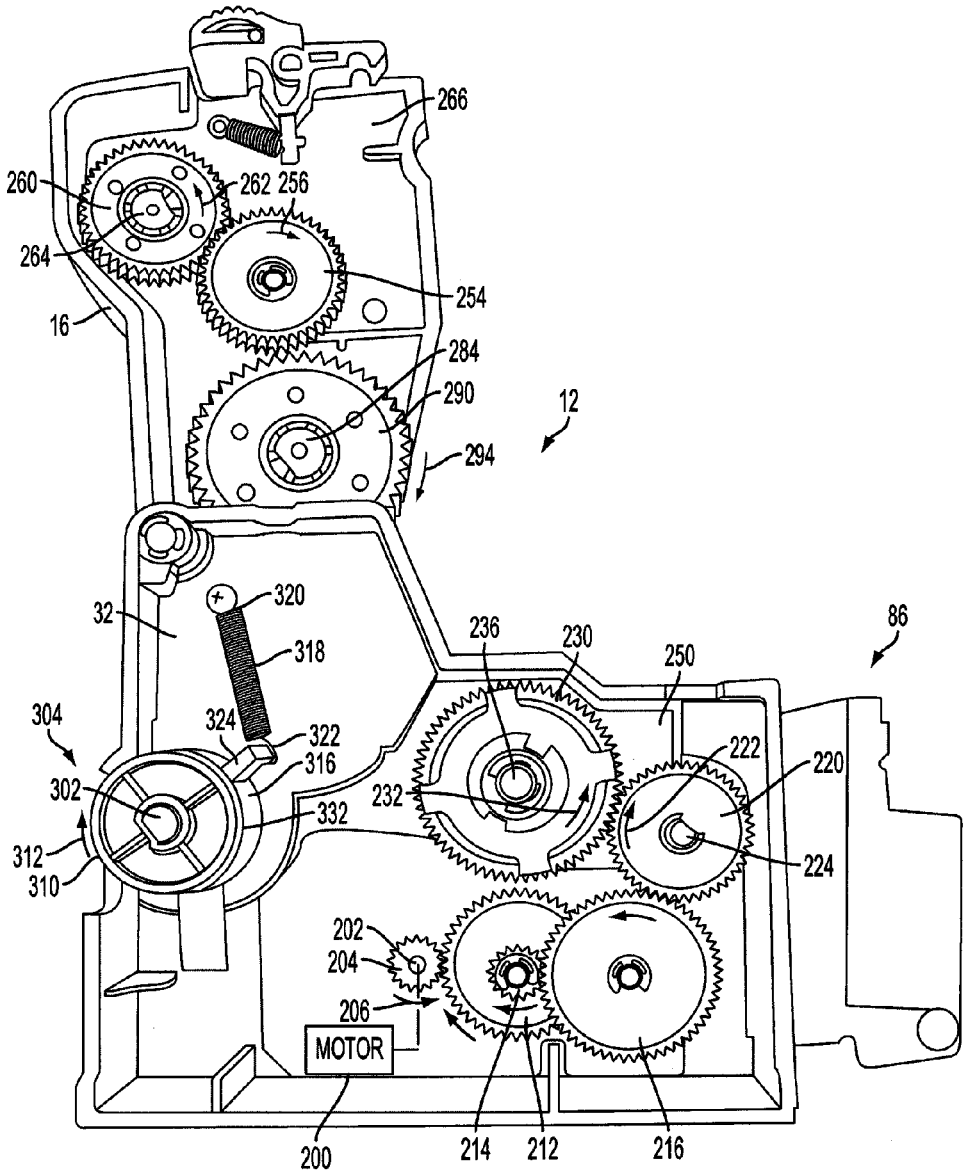
FIG. 8 is a side elevational view of an embodiment of a printer illustrating a print head carriage assembly and cover in an open position and drive mechanisms for moving substrate and a print thermal print ribbon through the printer.
Figure 9:
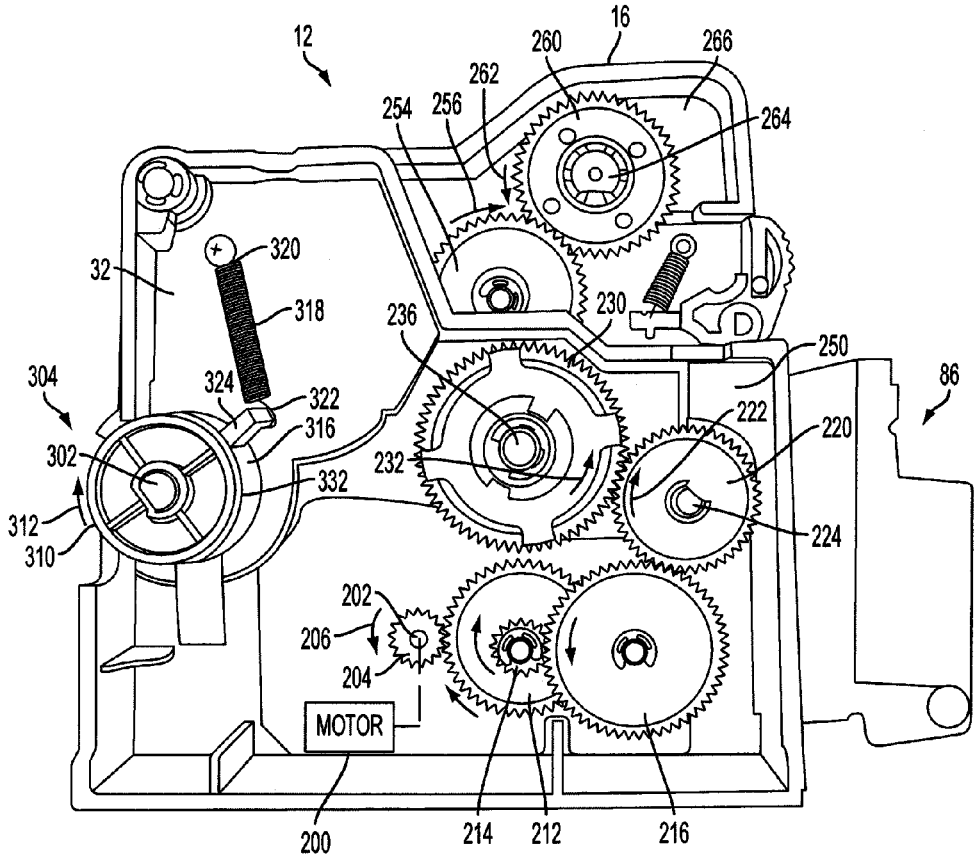
FIG. 9 is a side elevational view of the printer of FIG. 8 with the printer closed.
Figure 10:
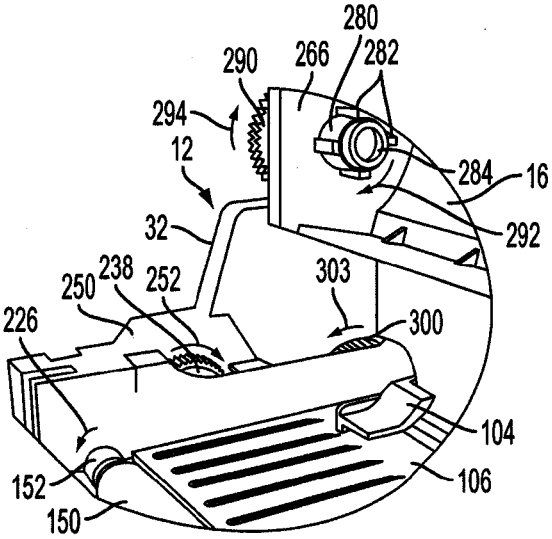
FIG. 10 is a perspective view of a portion of the printer of FIG. 8.

With specific reference to FIGS. 8, 9 and 10, a drive motor 200 is shown schematically in these figures. Drive motor 200 rotates a drive shaft 202 and a drive gear 204. The arrows shown in these figures represent the direction of rotation of gears shown therein when the substrate and ribbon are being advanced in a downstream direction through the printer. Thus, drive gear 204 is shown driven in counter-clockwise direction in FIGS. 8 and 9. Respective intermediate gears 212, 214 and 216 are driven, directly or indirectly, by gear 204 in the direction of the arrows shown thereon to drive a platen roller drive gear 220 in the direction of an arrow 222. A platen roller shaft 224 is driven by gear 220. With reference to FIG. 10, the platen roller axle or support 152 is attached to shaft 224 and driven in the direction 226, which is the direction of rotation 222, when the substrate is being driven by motor 200 in the downstream direction. The platen roller 150 rotates in the same direction 226 to move the substrate along the print flow path in the downstream direction. Conversely, rotation of axle 152 and roller 150 in a direction opposite to the direction 226 moves the substrate in an upstream direction. This can be accomplished by reversing the direction that the motor 200 rotates the motor drive shaft 202 so that arrow 206 (FIG. 8) would be clockwise.

The illustrated platen roller drive gear 220 also drives a ribbon take-up drive gear 230 in the direction of rotation of arrow 232 (counter-clockwise in FIGS. 8 and 9) when the substrate is moving in a downstream direction. Rotation of gear 230 rotates a ribbon take-up shaft 236 in the direction of arrow 232. Rotation of shaft 236 rotates a gear 238 (FIG. 10) fixed to shaft 236 that is located on the opposite side of a side wall 250 from the gear 230. The gear 238 is rotated in the direction of arrow 252 (FIG. 10) in response to the movement of gear 230 in the direction of arrow 232.

When the cover 16 is closed as shown in FIG. 9, rotation of gear 238 rotates an intermediate transfer ribbon take-up gear 254 in the direction of arrow 256 because the gear 254 is drivenly coupled to the gear 238 when the cover 16 is closed. When driven in this manner, gear 254 rotates an ink transfer ribbon take-up gear 260 in the direction of arrow 262 (counter-clockwise in FIG. 9). Gear 260 is mounted to a support shaft 264 that passes through and is journaled to a wall 266 of the cover. An ink transfer ribbon take-up spool support can be mounted to a projecting portion of shaft 264 on the opposite side of wall 266 from the side shown in FIG. 9. This ink transfer ribbon take-up spool support can be the same as the spool support for a spool or coil of ink transfer ribbon supplied to the printer as explained below. The spool can be held between opposed supports, with one of such supports being, for example, spring loaded, such that retraction of the spring loaded support axially and away from the adjacent spool end permits removal of the spool. Substrate supply and ink transfer ribbon supply spools can be detachably mounted to the printer in the same manner if desired. With reference to FIG. 10, an ink transfer ribbon supply spool support 280 is shown. The support 280 can have respective projections, some being indicated at 282 in FIG. 10, that can engage an inner hollow core at the end of the ink transfer ribbon supply spool. The illustrated ink transfer ribbon support 280 comprises a shaft portion 284 that extends through wall 266 of the cover.

As can be seen in FIG. 10, in this embodiment an ink transfer ribbon supply gear 290 is mounted to shaft portion 284. As ink transfer ribbon gear 230 is moved in the direction of arrow 232 (FIG. 8), the ink transfer ribbon is moved from the ink transfer ribbon supply in the downstream direction. In this case, ink transfer ribbon is pulled from the supply spool with the support 280 and gear 290 (FIG. 10) being rotated in the respective directions indicated by arrows 292 and 294. When the cover is closed, gear 294 engages a gear 300 (FIG. 10) and rotates gear 300 in the direction of arrow 303 when the substrate and ink transfer ribbon are being moved in the downstream direction. Gear 300 is mounted to a shaft 302 (FIGS. 8 and 9) that extends through a side wall of the housing and is rotatably supported by the side wall. A clutch mechanism 304 is coupled to shaft 302 to allow the delivery of ink transfer ribbon from the supply spool in the printer flow direction (downstream) as printing takes place with the substrate moving in the downstream direction. Clutch mechanism 304 provides tension that reverses the direction of movement of shaft 302 and gear 300 to take-up ink transfer ribbon and maintain tension on the ribbon in the event the direction of motion of the substrate is reversed to move in an upstream direction. A similar take-up mechanism can be included in the substrate supply. However, because of the stiffness of typical substrates used in thermal printing, a substrate take-up has been found to be unnecessary if the reverse (upstream) direction of motion of the substrate is only allowed for a limited back up distance.

Figure 11:
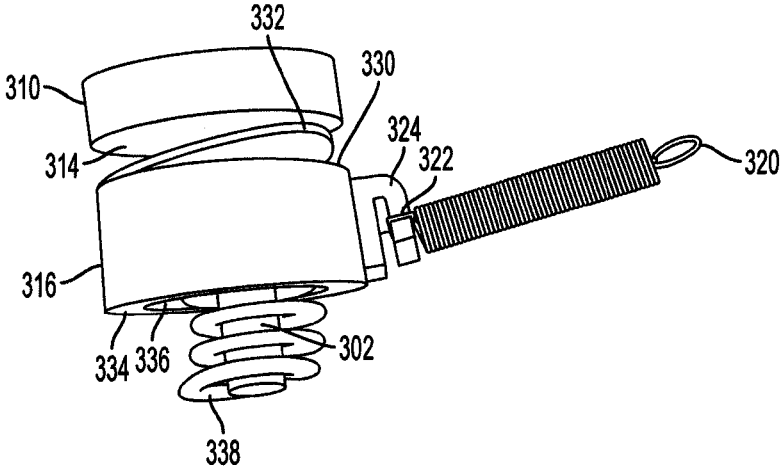
FIG. 11 is a perspective view of one form of a clutch mechanism that can be used in the printer of FIG. 8.

With reference to FIGS. 8, 9 and 11, the clutch mechanism 304 can comprise a first clutch disk portion 310 fixed to the shaft 302 for rotation in the direction of arrow 312 when ink transfer ribbon is being delivered in the downstream direction. Disk 310 comprises an inwardly facing disk surface 314 (FIG. 11). A second disk portion 316 of the clutch mechanism is rotatably supported on shaft 302. A tensioning spring 318, such as an elongated coil spring, has a first end portion 320 coupled to the housing and a second end portion 322 coupled to a projection 324 extending radially outwardly from the disk 316. Disk portion 316 comprises an outwardly facing disk surface 330 (FIG. 11) that faces disk surface 314. A disk pad 332, such as an annular piece of felt, is positioned between the surfaces 314, 330. The surface 334 of disk portion 316 opposite to surface 330 can comprise a hollow recess 336. A biasing element, such as a coil spring 338, surrounds the shaft 302 and has a first end portion abutting an interior surface of disk portion 316 within recess 336 and a second end portion abutting or coupled to an adjacent surface of the housing wall.

When assembled as shown in FIG. 8, as the printer operates and disk 310 is rotated in the direction of arrow 312, the spring 318 stretches and applies back tension to disk portion 316. The disk pad 332 allows disk portion 310 to rotate relative to disk portion 316 with the rotation of the shaft 302 so that ink transfer ribbon is played out from the spool as the substrate is moved in the downstream direction. In contrast, if the substrate is moved in the upstream direction (e.g., the direction 206 of rotation of gear 204 by motor 200 is reversed), the direction of rotation of ink transfer ribbon take-up gear 230 is also reversed. As a result, slack could exist in the ink transfer ribbon if not offset. To maintain tension on the ribbon, under these conditions the spring 318 moves the disk portion 316 in a ribbon take-up direction causing disk 310 to move in the direction opposite to arrow 312 and the shaft 302 to move in this opposite direction. This results in the movement of gear 290 (FIG. 10) in a direction opposite to arrow 294 and the taking up of slack in the ink transfer ribbon by the ink transfer ribbon support 280. This maintains the registration and alignment between the ink transfer ribbon and the substrate. When the substrate is again moved in the downstream direction, (e.g., by reversing the direction of rotation of gear 204 by motor 200), disk portion 316 is rotated in the direction of arrow 312 to again stretch the spring 318 to apply back tension. Under these conditions, the disk portion 310 again rotates in the direction of arrow 312, the ink ribbon supply gear 290 again rotates in the direction of arrow 294, and the ink transfer ribbon is again supplied in the downstream direction for printing.

Figure 12:
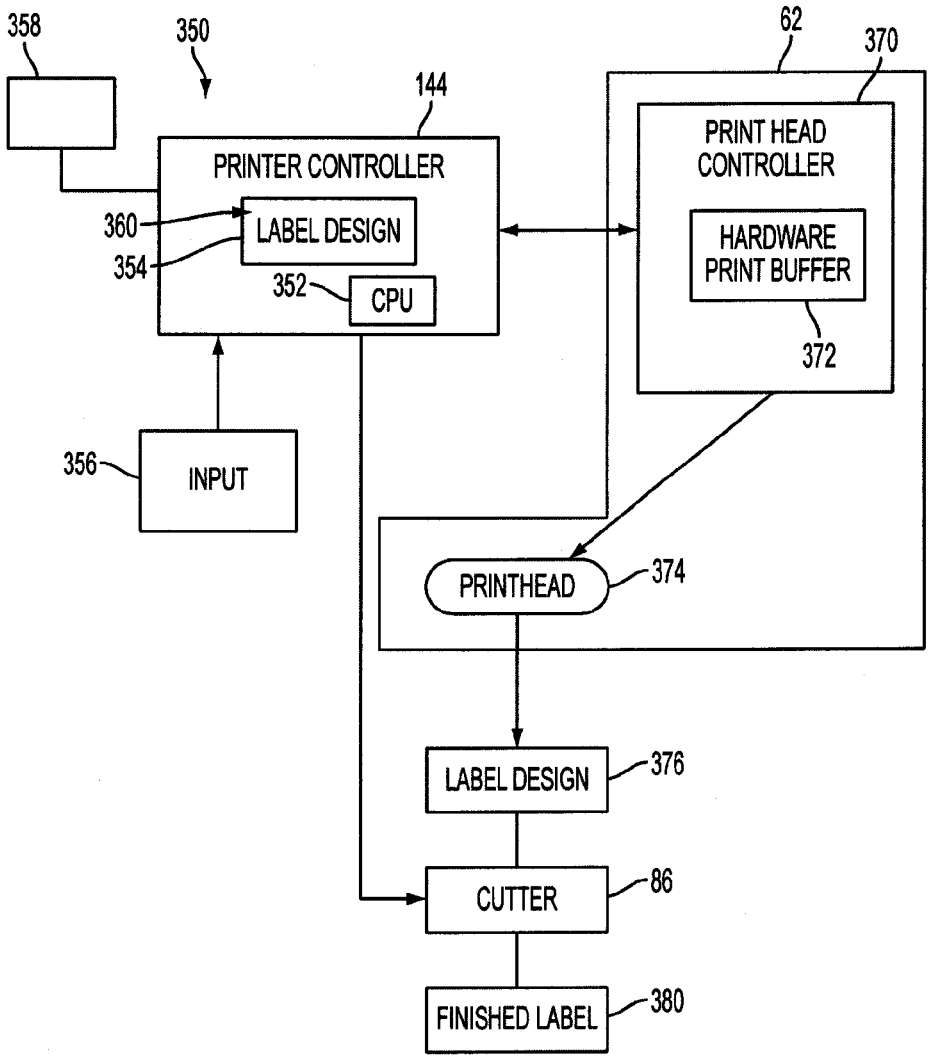
FIG. 12 schematically illustrates a printer embodiment that can selectively subdivide blocks of print data into sub-blocks of print data for printing on a label or other substrate piece.

With reference to FIG. 12, one exemplary control circuit for a thermal printer in accordance with this disclosure is schematically shown. It is to be understood that the illustrated printer control can of course be modified. In FIG. 12, a printer controller 350 is shown and can be mounted on the printed circuit board 144. The illustrated printer controller comprises a microprocessor or central processing unit 352 and associated memory 354 that can comprise any suitable form of memory. An input device 356 is shown coupled to the printer controller. The input device can comprise a keyboard, touchscreen, disk reader and/or any other suitable device for delivering print data and other instructions to the print controller. The printer can also comprise a display, such as a display screen indicated at 358, that can be viewed by a user of the input device to monitor the progress of an input and/or to design a label or message. As one specific example, input device 356 can be used to design a message to be printed, such as indicated by the label design 360 schematically shown stored in memory 356. The print data for printing the depicted label would typically be stored in digital form. Desirably, the printer controller and other components are self-contained as part of a portable printer unit. However, discrete components can be utilized. In addition, wireless connections as well as hard-wired connections can be used between components. Also, computing functions can be accomplished in the cloud using wireless communication protocols. Print data corresponding to the label design or message to be printed by the printer is delivered in this example from the printer controller to memory of a print head controller 370, such as to a hardware print buffer 372 of the print head controller. This print data is then used by the print head controller to control the operation of a thermal print head 374 to cause heating of desired pixels in the print head as the substrate and ink transfer ribbon pass the print head in the downstream direction. This results in printing of the label design on a label, as indicated at 376. In an example where a substrate is supplied from a continuous roll of substrate, as opposed to discrete pieces of substrate which can alternatively be used, following printing of the print data, the printer controller controls the operation of the cutter 86 to sever the printed label or other message from the roll to produce the finished label 380.

If the message to be printed on the substrate, such as the label design, requires a quantity of print data to print that exceeds the capacity of the print head controller memory 372, some of the message would be truncated during printing if the print data is not properly handled. In such cases, as well as otherwise when desired, the block of print data required to print the entire label (the term label is used for convenience as it is to be understood that the term label encompasses any substrate printing task) can be subdivided into sub-blocks that do not exceed the memory capacity of the print head controller. Although less desirable, the subdivision into the sub-block mode of operation can also be implemented even if the print head memory is sufficiently large to store print data for the entire message. These sub-blocks of data can then be delivered to the print head in succession with one sub-block being printed on the label, followed by the printing of the next sub-block, and so forth. The end result is a label with individually printed sub-blocks that are in effect stitched together or joined on the resulting finished label. If one were to simply print a sub-block and start printing the next sub-block on the portion of substrate which immediately follows the prior printed sub-block, a printing artifact can exist between the two printed sub-blocks. For example, a blank gap could exist. As another example, as a heated print head remains stationary over a portion of substrate while waiting for the next sub-block of data, the print head can cause streaking of the printed label.

In accordance with this disclosure, it has been discovered that, by backing up the substrate a back distance and then in effect overprinting the backed up area of the substrate with corresponding data when printing the next sub-block, smoother transitions in printing between sub-blocks of data are achieved. That is, a first sub-block of data can be printed with the substrate traveling in a downstream direction, the substrate travel can then be reversed to travel upstream for a back distance, and a second sub-block of data can then be printed on the substrate traveling in a downstream direction. The data being printed onto the back distance or back space area, as the substrate travels in the downstream direction and the back distance again passes the thermal print head, corresponds to the data printed from the preceding sub-block of data onto the back distance portion of the substrate. By corresponding, it is meant that the data applied to the print back distance portion during the subsequent printing of the back distance is preferably identical to the data printed during the preceding printing of the back distance portion. However, it is to be understood that some deviation from print data identity is permissible that does not result in significant visually detracting artifacts in the transition region. For example, during reprinting of the overlap area as the substrate is moved in the downstream direction, only a selected portion of the originally printed data can be used for printing the back distance or overlap area.

Figure 13:
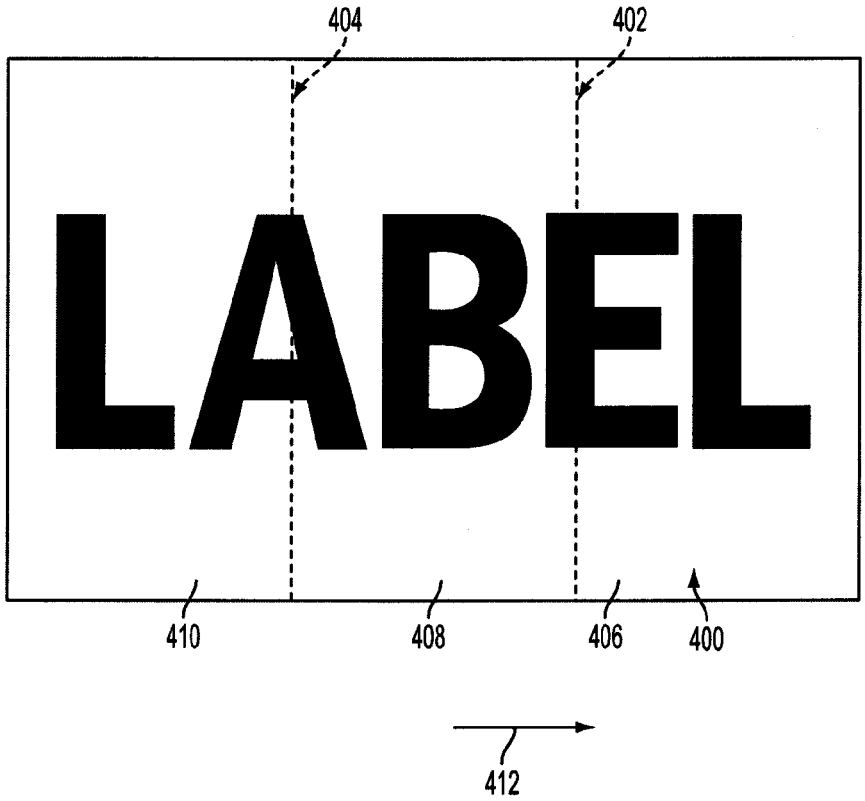
FIG. 13 illustrates an exemplary label with schematically indicated imaginary subdivision lines shown in dashed lines on the label.

FIG. 13 illustrates a length of substrate 400 that one can assume includes too much data for printing by a thermal print head without overflowing the limits of data storage in a print head controller memory. In this example, imaginary dashed lines 402, 404 are shown that subdivide the label 400 into first, second and third successive label sections or portions 406, 408 and 410. The label sections 406, 408, 410 can be of identical length, or they can be of a variable length. For example, sections 406 and 408 can be of one length and section 410 can be of a shorter length. Subdividing line 402 is at the trailing edge (with reference to the downstream direction 412) of section 406 and the leading edge of section 408. In addition, subdivision line 404 is at the trailing edge of section 408 and the leading edge of section 410.

Figure 14:
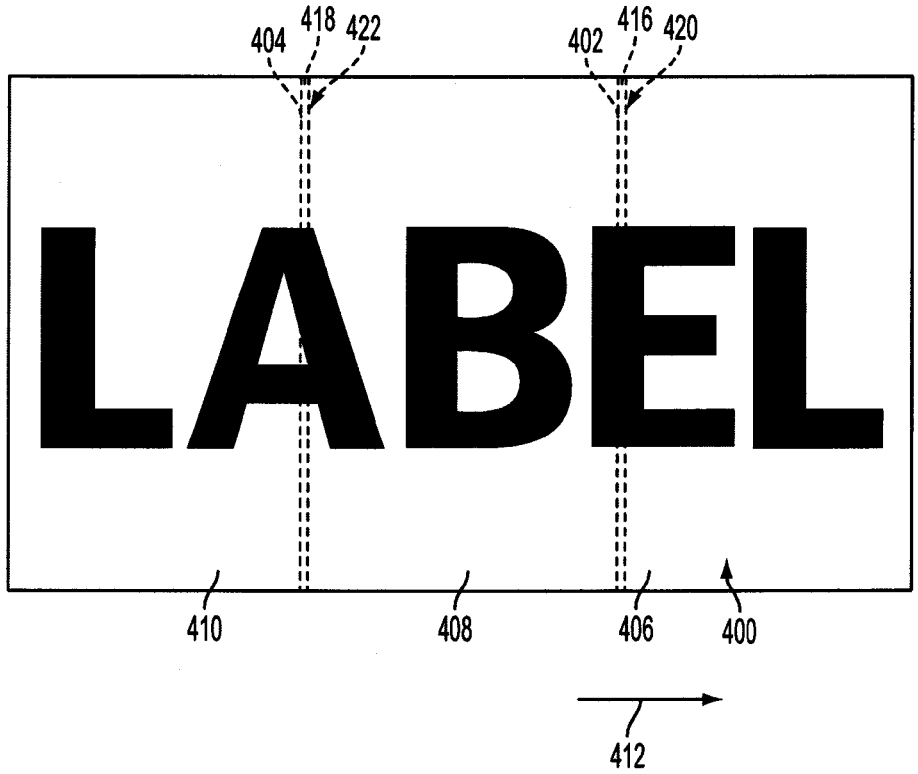
FIG. 14 illustrates the label of FIG. 13 with back distance areas between first and second and second and third label sub-portions shown schematically by imaginary dashed lines thereon.

FIG. 14 illustrates the label 400 with imaginary subdivision lines 420, 422 shown thereon. Subdivision line 420 is spaced from line 402 in the downstream direction by a back distance or gap indicated by the number 416. Subdivision line 422 is spaced in the downstream direction from the line 404 by a back or gap distance 418. During printing, as will be explained more fully below, the substrate can be moved in the downstream direction with print data initially printed in the gap or back distance portion 416 being from print data in the first subdivided block of print data. The initial printing of the first sub-block of print data stops at imaginary line 402. Thereafter, the substrate can be moved in the upstream direction to position line 420 at the location for printing again by the thermal print head. The back distance portion 416 can then be again printed with data from the second (next) sub-block of data as the substrate is again moved in the downstream direction indicated by arrow 412. When the second sub-block of data is printed, the back distance area 416 is printed and printing continues through the line 404. The print data printed in the back distance portion 416 from the second sub-block of data corresponds to the data printed in the back distance area from the first sub-block of data. The substrate is then moved in the upstream direction through the back distance 418 to again position the line 422 at the location for printing by the thermal print head. The substrate is then moved in the downstream direction with the third subdivided block of data then being printed on section 410 starting with the printing of the back distance portion 418 with print data from the third sub-block that corresponds to the print data previously printed on the back distance 418 during printing of the second sub-block of print data.

In a more generalized example of a printing method, the method comprises subdividing a block of data to be printed by a thermal print head of a thermal printer onto a length of substrate into N data sub-blocks, N being greater than one with the sub-blocks to be printed in order from the first sub-block to the $N^{th}$ sub-block, each sub-block to be printed on an associated portion of the substrate with the first sub-block printed on a first portion of the substrate, the second sub-block printed on a second portion of the substrate through and including the $N^{th}$ sub-block printed on the $N^{th}$ portion of the substrate;

a. moving a first portion of the substrate in a first direction past the thermal print head;

b. printing the first portion of the substrate passing the thermal print head in the first direction with the first sub-block of data during a first printing act;

c. interrupting the printing of the substrate by the thermal print head following printing of the first sub-block of data and reversing the direction of movement of the substrate such that a back distance section of the first portion of the substrate passes the thermal print head in a second direction opposite to the first direction;

d. moving a second portion of the substrate that includes the back distance section in the first direction past the thermal print head such that the back distance section of the substrate again passes the thermal print head in the first direction;

e. printing the second portion of the substrate passing the thermal print head in the first direction with the second of the sub-blocks of data during a second printing act, the portion of the second sub-block of data printed on the back distance section of the substrate during the second printing act corresponding to the data printed on the back distance section of the substrate during the first printing act;

f. repeating the steps a through c for each succeeding portion of the substrate from the third substrate through the $N-1^{th}$ substrate with the third sub-block of data being printed on the third portion of the substrate through and including the $N-1^{th}$ sub-block of data being printed on the $N-1^{th}$ portion of the substrate;

g. moving the $N^{th}$ portion of the substrate that includes the back distance section in the $N-1^{th}$ portion of the substrate in the first direction past the thermal print head such that the back distance section of the $N-1^{th}$ portion of the substrate again passes the thermal print head in the first direction;

printing the $N^{th}$ sub-block of data on the $N^{th}$ portion of the substrate passing the thermal print head in the first direction during an $N^{th}$ printing act, the portion of the $N^{th}$ sub-block of data printed on the back distance section of the substrate during the $N^{th}$ printing step corresponding to the data printed on the back distance section of the substrate during the $N-1^{th}$ printing act; and severing the substrate from the substrate coil following the printing of the $N^{th}$ sub-block of data.

Figure 15:
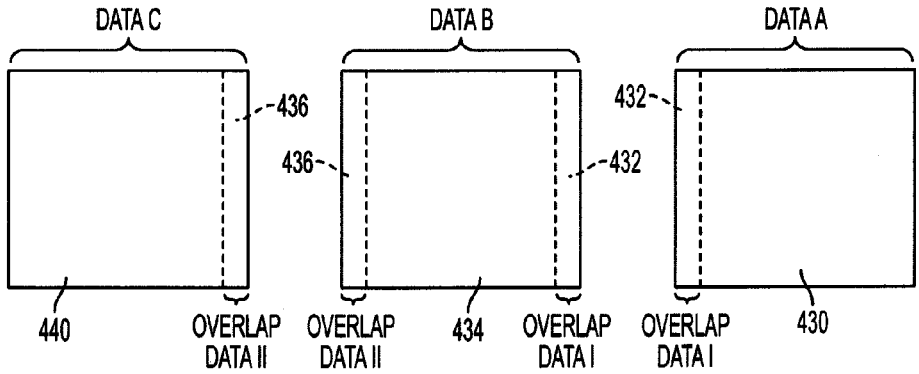
FIGS. 15 and 16 illustrate subdivisions of a block of data into sub-blocks of data.
Figure 16:
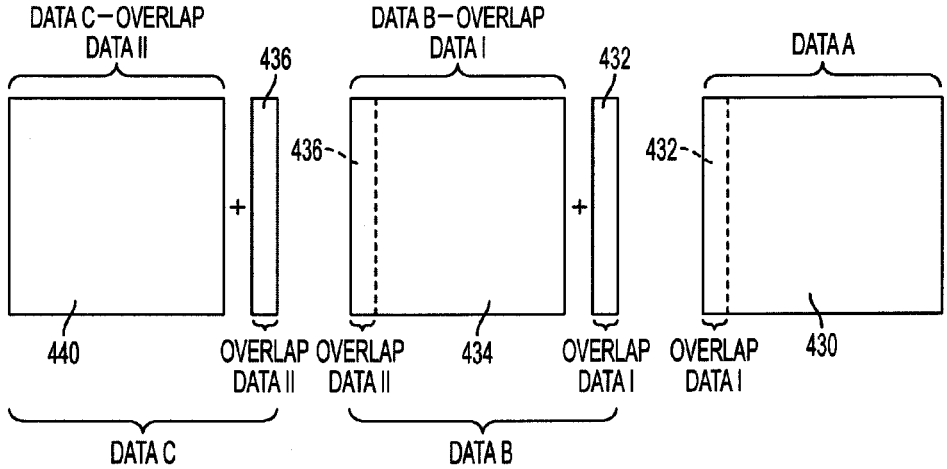

FIGS. 15 and 16 illustrate two exemplary approaches for subdividing a block of data for an entire message to be printed on a label, banner or other work piece (each included within the term label). With reference to FIG. 15, by way of example, the block of data for printing a message has been divided into three sub-blocks of data, labeled data A, data B and data C. Data sub-block A is the data for printing on a first portion of the substrate. Data sub-block A includes overlap data I for the portion of the message to be printed on the first back distance portion of the substrate. It is to be understood that the reference to data to be printed includes data, or lack thereof, corresponding to blank spaces where no such printing is to take place. As a first portion of the substrate is moved in the downstream direction, the message represented by the print data of data sub-block A, stored in the print head memory or otherwise, is printed on the substrate. Data sub-block A can then be erased, overwritten or otherwise discarded from the print head memory either following printing or as printing takes place. In the case of a limited sized print head memory, after memory space becomes available, data sub-block B, shown in the middle of FIG. 15, can be loaded into the print head memory. For convenience, data sub-block A is indicated as comprising a first portion of print data 430 and a second portion of print data 432 for printing on the overlap area of the substrate. Although it is desirable to store the data in the print head memory sequentially, the sub-sub-block of data corresponding to the print data 432 can be otherwise stored with its location identified for calling up for delivery to the print head for printing at the appropriate time. Following the printing of the first portion of the substrate with the message corresponding to the print data of data sub-block A, the direction of travel of the substrate is reversed for a back distance. The back distance can be predetermined and stored in memory associated with the printer controller or elsewhere, with the printer controller initiating the back distance travel of the substrate for the length of the back distance following printing of the first data sub-block A. The data can be printed in rows of pixels extending transversely across the substrate, desirably the rows extending in a direction perpendicular to the downstream direction of travel of the substrate. The back distance can be a predetermined number of pixels in the direction of substrate travel. Desirably, the back distance is between 15-25 pixels. In numerical terms, a desirable back distance is 1.5 mm. It is to be understood that all dimensions expressed in this description include some deviation from the specifically recited dimensions, such as a ten percent deviation, or a somewhat larger deviation.

After the substrate has been moved in reverse (upstream) the back distance, the second data sub-block, data sub-block B in FIG. 15, can be delivered to the print head memory with the printer controller operated to control the printing by the print head of the message corresponding to the data of data sub-block B. Data sub-block B in FIG. 15 contains the overlap data 432 to be printed on the back distance space, a second sub-sub-block of data 434 for an additional portion of the message to be printed on the second portion of the substrate following the printing of the overlap data, and a next portion of overlap data 436, (overlap data II), for printing on a trailing edge portion of the second portion of the substrate. The trailing edge portion being the back distance associated with the ending portion of print data of data sub-block B. Following the printing of the back distance portion of the message in response to data sub-sub-block 436, the printer controller again causes the substrate to reverse direction and travel upstream for the next back distance. Data from a data sub-block C to be printed on the next section of the substrate is delivered to the print head memory, or another location. The substrate is again moved in the downstream direction with the message corresponding to the data of data sub-block C being printed on the next portion of the substrate. Data sub-block C comprises a first sub-sub-block of data 436 to be printed on the back distance area that was printed with the print data 436 of sub-block B. Thus, corresponding data from data sub-block B and data sub-block C are printed on the back distance area. The data corresponding to the remainder of the message 440, assuming data sub-block C contains the last data for the message to be printed, is then printed by the print head. Since, in this example, data sub-block C is the last data sub-block of the message, there is desirably no back distance area at the end of data sub-block C. Similarly, since data sub-block A was the first sub-block of the message, there is desirably no back distance area at the leading edge of data sub-block A. Although it is desirable for each of the back distances to be the same, this is not a requirement.

FIG. 16 illustrates another exemplary method of providing sub-blocks of data for a block of data that is subdivided. In FIG. 16, the first data sub-block A is identical to the first data sub-block A of FIG. 15. However, in processing data sub-block A, the sub-sub-block of data 432 for the back distance is identified and not erased or discarded while printing the message corresponding to data sub-block A onto the substrate. Instead, this back distance data (sub-sub-block 432) is added to a second data sub-block that corresponds to data sub-block B in FIG. 15 less the overlap data 432. Consequently, the overlap print data 432 from data sub-block A is simply stitched or added to the next received sub-block of data to provide data sub-block B. Similarly, the print data corresponding to the second back distance portion indicated at 436 in FIGS. 15 and 16, is identified and added to a sub-block of data 440 corresponding to data sub-block C minus the overlap data II to produce the data sub-block C.

It is to be understood that other methods of subdividing a block of data into sub-blocks can be used, while still providing for reprinting of at least some data corresponding to the data printed at a trailing portion of a preceding portion of the substrate in a back distance area on the leading edge portion of the succeeding printed portion of the substrate.

Figure 17:
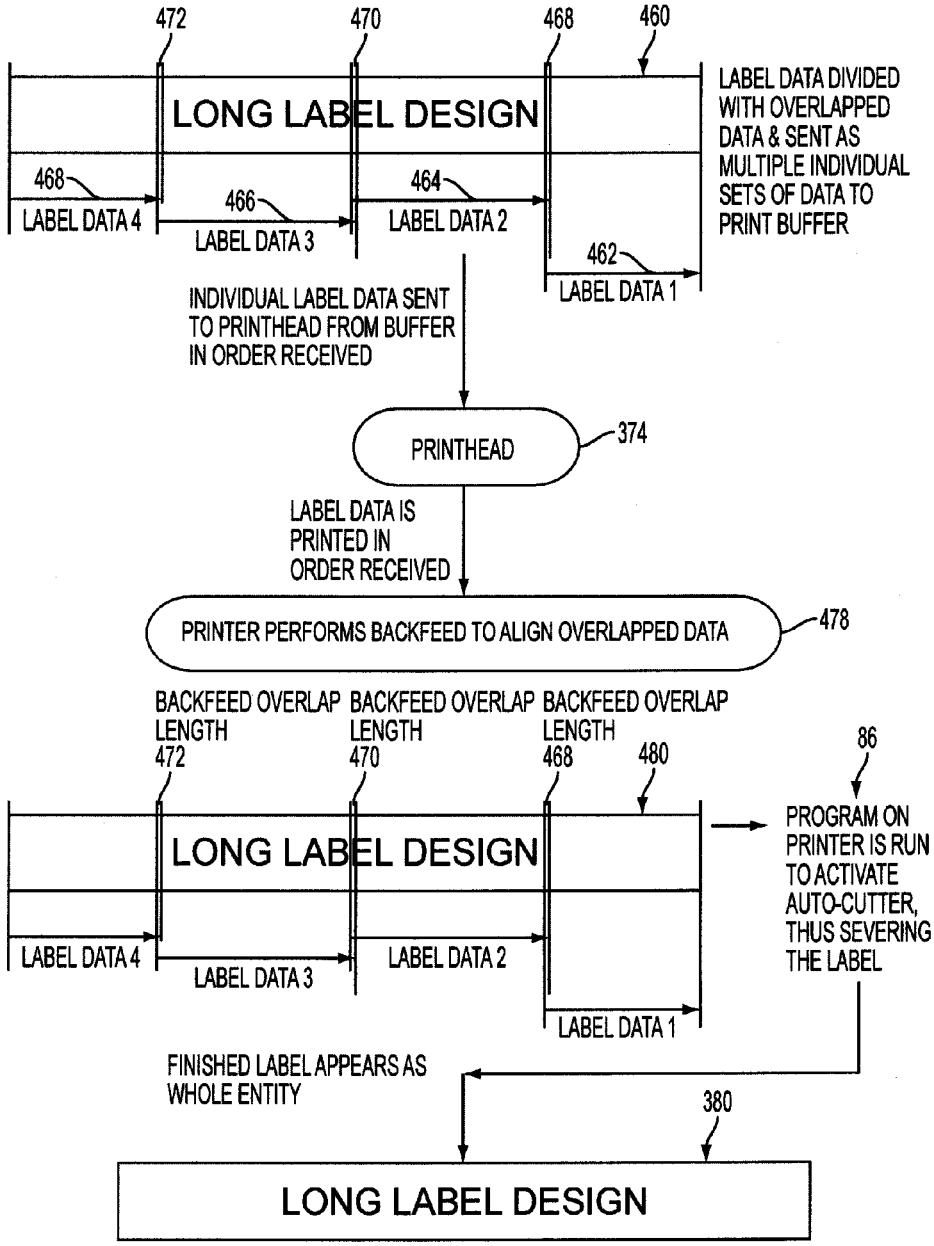
FIG. 17 schematically illustrates an exemplary process for subdividing a label design into plural sub-portions of print data and printing the sub-portions into a completed label with back feed distances positioned between adjacent sub-portions of the label.

For purposes of clarification, an exemplary printing process is again described with reference to FIG. 17. In a first portion of the process as indicated at 460 in FIG. 17, a determination is made that the label is not suitable for printing as one continuous label. For example, it is determined that the length of the label exceeds a maximum length, which maximum length can be predetermined. The block of data for the entire label is then subdivided into sub-blocks or chunks of data that are to be printed in succession. The sub-blocks in this example are identified as 462, 464, 466 and 468 (also indicated as Label Data 1, Label Data 2, Label Data 3 and Label Data 4 in FIG. 17). In this example, Label Data 1 is for printing on a first portion of a substrate, Label Data 2 is for printing on the next or second portion of the substrate, Label Data 3 is for printing on the following or third portion of the substrate and Label Data 4 is for printing on the last portion of the substrate to complete the printing of the entire label. The Label Data in FIG. 17 has been divided in the manner described above in connection with FIG. 15 in this example. Thus, Label Data 462 includes data for a first back up distance 468, Label Data 2 contains label data for the first back up distance and Label Data for a second back up distance 470 between the second and third portions of the label to be printed. In addition, Label Data 3 includes label data for the second back up distance 470 and label data for a third back up distance 472 between the third and fourth substrate portions. Finally, the last label data sub-block (Label Data 4) includes the label data for the last back up distance 472, and the label data for the remaining message. These respective sub-blocks of label data can correspond to print pages that are each sent to the print head 374 as a single print job. Thus, in the example of FIG. 17, the respective sub-blocks of data are sent individually, in succession, as individual sets or pages of data to the print head memory, such as to a print head buffer.

The individual sub-blocks of data can then be delivered from the print head memory, such as from a print head buffer, to the print head in the order received. The label data is desirably printed in the order received with the first sub-block of print data being printed on a first portion of the label substrate, the second sub-block of print data being printed on a second portion of the label substrate, the third sub-block of print data being printed on the third portion of the label substrate and the fourth sub-block of print data being printed on the fourth section of the label substrate. During this printing operation, as indicated at 478, the printer controller operates the motor, which can comprise a stepper motor with feedback to track the position of the motor and substrate, to reverse the direction of travel of the substrate for respective back distance areas or length as previously described. The overlapped data is printed in the back distance areas as described above to minimize artifacts between the printed sub-blocks of data in the finished overall label. The backfeed overlap lengths between respective sub-portions of the label to provide the back distances 468, 470 and 472 are illustrated schematically at 480 in FIG. 17. Following printing of the entire label, the cutter 86 can be controlled by the printer controller to sever the label from the remaining substrate, for example if the substrate is being fed from a coil of substrate. The finished label then appears as an entire completed label, indicated at 380 in FIG. 17.

Figure 18:
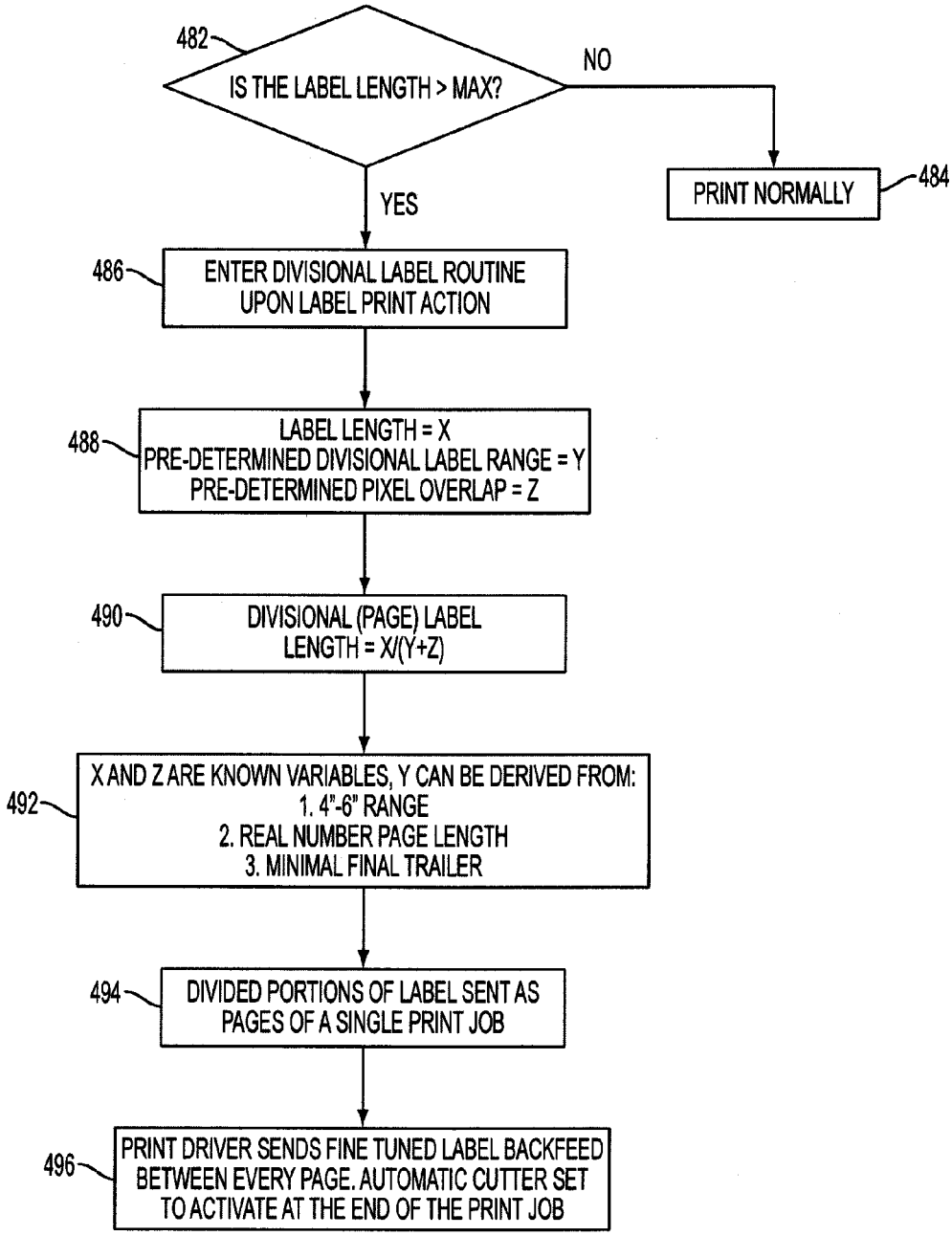
FIG. 18 illustrates an exemplary flow chart for a printer controller operable to print a label in accordance with the approach of FIG. 17.

An exemplary process for a printer controller to control the subdivision of a block of data into sub-blocks is shown in FIG. 18. In this process, at block 482 a question is asked whether the label length is greater than a maximum label length corresponding to the longest label that the printer is to print without subdividing the block of label data into sub-blocks of label data. The maximum length, in the case of a printer with a print head memory of constrained capacity, is set to be no greater than the memory capacity of the print head memory. As one specific example, the maximum label length can be set at thirty inches, or some other predetermined value. Alternatively, the number of rows of pixels to be printed for the entire label can be evaluated from the completed label design to determine the label length and compared with a maximum label length to determine whether subdivision of the print data into sub-blocks of print data is desired.

If the answer at block 42 is no, a block 484 is reached and the entire label is printed (as indicated by the Print Normally statement in this block) at one time without any backfeed of subdivided blocks of data. Following printing, in the case of a continuous substrate or a substrate piece that is longer than the desired length of the finished label, the print controller can operate the cutter to cut the label to the finished label length. If the label length is greater than the maximum label length, from block 482, a block 486 is reached and a divisional label routine is followed to result in subdividing the print data into sub-blocks of print data. The divisional label routine can be entered upon or in response to a print action instruction provided to the printer controller 350 (FIG. 12), such as in response to an input from an input device 356.

Blocks 488, 490 and 492 comprise one exemplary divisional sub-label routine. In one specific example, the overall label length is indicated as x, which again is greater than the maximum label length in this example. Note: The maximum label length can be varied. In addition, as an alternative, one can select the divisional label option without regard to the label length (e.g., even if the label length is less than some maximum, such as always entering the sub-block backfeed mode of operation). The label length x can be determined or specified in a desired manner, such as entered by a user into the printer controller or computed from the number of rows of pixels in the label design. A divisional label range (length of sub-portions of substrate to be printed by a sub-block of data) is then selected. This divisional label range can be predetermined or preset. In a desirable example, a divisional label range is set between four inches and six inches. Longer divisional ranges can increase the risks of print artifacts due to misalignments between the actual location being printed on the substrate by a print head and the location of data corresponding to back distance areas. The divisional label range can also be computed, such as dividing the label length equally into equal length sub-portions falling within a desired range. As another alternative, the label length sub-portions need not be equal. For example, a desirable label sub-length portion can be divided into the overall label length to determine the number of sub-portions with any leftover or remainder label length being the final sub-portion length. The overlap distance can then be established and/or can be pre-established. Desirably, the number of pixels (length of the overlap distance) in the overlap distance is from fifteen to twenty-five pixels. A specific example of a desirable overlap distance is 1.5 mm. The pixel overlap length can be varied based on parameters, such as the size of the pixels and length of the label. For example, the label overlap distance can be increased with increasing pixel size and decreased with decreasing pixel size.

The overlap distance can also be calibrated and adjusted to accommodate alignment variations due to differences between printers. For example, the characteristics of motors, platen size, timing of pixel firing and other parameters can differ slightly between printers including between different printers of the same model. To account for these differences, the backup distance (printer feed/back feed distance) can be adjusted, such as by fractions of a millimeter, to properly align the printing of the backup area by data from a succeeding sub-block of data. The calibration offset can be hard coded into printer firmware. Alternatively, calibration can be performed in situ by software to incrementally increase or decrease the back distance setting, such as in response to a user request, to determine a calibrated back distance that minimizes any printing artifacts. The back distance determined in this manner can then be stored and used during printing. That is, the user can instruct an increase in the backup distance by one or more increments or a decrease in the backup distance by one or more increments to eliminate significant artifacts due to misalignments during reprinting of the backup area. Alternatively, hardware sensors can monitor the output labels for artifacts and adjust the backup distance to eliminate the undesirable artifacts.

In addition, printers can have a gap between the time a printer is supposed to start firing pixels for ink transfer and when a platen actually starts moving the substrate being printed. Some printers compensate for this by starting to feed the substrate stock before the pixels start firing, which can result in a blank margin of unprinted area. The overlap or back feed distance can be adjusted to compensate for this blank feed margin by adding the blank feed margin to the offset distance, such as during the calibration mentioned above. That is, the back feed distance can be extended beyond the desired print overlap distance to a longer distance including the blank feed distance that allows the label substrate to start feeding with the pixels actually starting to fire following the blank feed margin distance so that the overlap print portions of two sub-blocks of data are properly aligned.

At block 490 the divisional or sub-portion length is computed. For example, the overall label length can be divided by the sum of the pixel overlap length and the sub-portion length falling within the divisional label range. Alternatively, the divisional page label length (length of the sub-portion), can simply be established at a desired value, such as five inches.

In block 492, as one specific example, a pre-determined divisional label range of four inches to six inches is set. A real number page or sub-portion length (four, five or six inch) can be selected and divided into the overall label length, with the remainder, or final trailer length, being determined. The page length can then be selected that results in a final trailer of a minimum length, as often the final trailer has no printing thereon.

At block 494 the process continues with the subdivided portions of the label print data being sent to the print head memory, and then used to control the thermal print head of the printer, as pages of a single print job. At block 496 the printer controller causes the label backfeed between every page as previously described. The cutter can then be controlled or pre-instructed, to activate at the end of the entire label print job to sever the label.

Throughout this disclosure, when a reference is made to the singular terms "a", "and", and "first", it means both the singular and the plural unless the term is qualified to expressly indicate that it only refers to a singular element, such as by using the phrase "only one". Thus, for example, if two of a particular element are present, there is also "a" or "an" of such element that is present. In addition, the term "and/or" when used in this document is to be construed to include the conjunctive "and", the disjunctive "or", and both "and" and "or". In the case of a list of more than two items with the phrase "and/or" between the next to last and last item of the list, the term "and/or" means any one or more or all of the items on the list in all possible combinations and sub-combinations. Also, the term "includes" has the same meaning as comprises.

Having illustrated and described the principles of our invention with reference to a number of embodiments, it should be apparent to those of ordinary skill in the art that the embodiments may be modified in arrangement and detail without departing from the inventive principles disclosed herein. We claim as our invention all such embodiments as fall within the scope of the following claims.

We claim:

1. A thermal printing method comprising:

moving a first portion of a substrate to be printed in a first direction past a thermal print head;

printing the first portion of the substrate passing the thermal print head in the first direction with a first sub-block of data of a block of data during a first printing act;

interrupting the printing of the substrate by the thermal print head following printing of the first sub-block of data and reversing the direction of movement of the substrate such that a back distance section of the first portion of the substrate passes the thermal print head in a second direction opposite to the first direction;

moving a second portion of the substrate that includes the back distance section in the first direction past the thermal print head such that the back distance section of the substrate again passes the thermal print head in the first direction; and printing the second portion of the substrate passing the thermal print head in the first direction with a second sub-block of data during a second printing act, the portion of the second sub-block of data printed on the back distance section of the substrate during the second printing act corresponding to the data printed on the back distance section of the substrate during the first printing act.

2. A method according to claim 1 comprising comparing the length of the substrate to be printed with the block of data to a maximum unsubdivided length, and, if the length exceeds the maximum unsubdivided length, subdividing the block of data into plural sub-blocks of data for thermal printing on portions of the substrate that are each less than the maximum length, and repeating the steps of claim 1 to print each sub-block of data onto an associated portion of the substrate.

3. A method according to claim 1 wherein the act of subdividing the data comprises subdividing the data into sub-blocks of data for printing on equal length portions of the substrate.

4. A method according to claim 3 wherein the equal length portions of the substrate are between four and six inches.

5. A method according to claim 3 wherein the act of reversing the direction of movement comprises reversing the direction of movement by a back distance section that is a predetermined number of pixels.

6. A method according to claim 5 wherein the predetermined number of pixels is from 15 to 25 pixels.

7. A method according to claim 3 wherein the act of reversing the direction of movement comprises reversing the direction of movement by a back distance of about 1.5 mm.

8. A method according to claim 1 wherein the act of subdividing the data comprises subdividing the data into sub-blocks of data for printing on portions of the substrate of different lengths.

9. A method according to claim 1 wherein the thermal print head has a print head driver memory of a first size, the sub-blocks of data being no greater in size than can be received and stored at one time in the print head driver memory, the method comprising delivering a successive sub-block of data to the print head driver memory following the printing of a portion of the substrate by the thermal print head with a sub-block of data stored in the print head driver memory.

10. A method according to claim 1 wherein the printing steps comprise printing the substrate from a thermal print ribbon, the method further comprising the act of moving the thermal print ribbon in the first direction past the thermal print head with the moving of the substrate in the first direction, and the act of applying back tension to the print ribbon to move the ribbon in the second direction past the print head as the substrate is moved in the second direction.

11. A method according to claim 1 wherein the acts of moving first and second portions of a substrate comprises moving portions of a substrate from an elongated coil of substrate, the method comprising determining a length of substrate required to print the entire block of data and following the printing of the last sub-block of successive sub-blocks of data making up the block of data, severing the printed portions of the substrate containing the entire block of data from the coil of substrate.

12. A thermal printing method for printing a substrate from a thermal print ribbon in response to print data comprising:

subdividing a block of data to be printed by a thermal print head of a thermal printer onto a length of substrate into N data sub-blocks, N being greater than one with the sub-blocks to be printed in order from the first sub-block to the Nth sub-block, each sub-block to be printed on an associated portion of the substrate with the first sub-block printed on a first portion of the substrate, the second sub-block printed on a second portion of the substrate through and including the Nth sub-block printed on the Nth portion of the substrate;

a. moving a first portion of the substrate in a first direction past the thermal print head;

b. printing the first portion of the substrate passing the thermal print head in the first direction with the first sub-block of data during a first printing act;

c. interrupting the printing of the substrate by the thermal print head following printing of the first sub-block of data and reversing the direction of movement of the substrate such that a back distance section of the first portion of the substrate passes the thermal print head in a second direction opposite to the first direction;

d. moving a second portion of the substrate that includes the back distance section in the first direction past the thermal print head such that the back distance section of the substrate again passes the thermal print head in the first direction;

e. printing the second portion of the substrate passing the thermal print head in the first direction with the second of the sub-blocks of data during a second printing act, the portion of the second sub-block of data printed on the back distance section of the substrate during the second printing act corresponding to the data printed on the back distance section of the substrate during the first printing act;

f. repeating the steps a through c for each succeeding portion of the substrate from the third substrate through the $N-1^{th}$ substrate with the third sub-block of data being printed on the third portion of the substrate through and including the $N-1^{th}$ sub-block of data being printed on the $N-1^{th}$ portion of the substrate;

g. moving the $N^{th}$ portion of the substrate that includes the back distance section in the $N-1^{th}$ portion of the substrate in the first direction past the thermal print head such that the back distance section of the $N-1^{th}$ portion of the substrate again passes the thermal print head in the first direction; and printing the $N^{th}$ sub-block of data on the $N^{th}$ portion of the substrate passing the thermal print head in the first direction during an $N^{th}$ printing act, the portion of the $N^{th}$ sub-block of data printed on the back distance section of the substrate during the $N^{th}$ printing step corresponding to the data printed on the back distance section of the substrate during the $N-1^{th}$ printing act; and severing the substrate from the substrate coil following the printing of the $N^{th}$ sub-block of data.

13. A thermal printer for printing a substrate from a thermal print ribbon in response to print data comprising:

a substrate holder for supporting a coil of substrate;

a thermal print ribbon holder for supporting a coil of thermal print ribbon;

a thermal print head in a print flow path;

a platen rotatable in respective opposite first and second directions and positioned adjacent the thermal print head, the platen engaging the substrate from the roll of substrate and advancing the substrate in the print flow path in a first downstream direction past the thermal print head upon rotation of the platen in the first direction and reversing the direction of movement of the substrate to move the substrate in a second upstream direction opposite to the first direction upon rotation of the platen in the second direction;

a substrate drive motor coupled to the platen and operable to rotate the platen in the respective first and second directions;

a ribbon take-up positioned to take up ribbon at a ribbon take-up location of the ribbon downstream in the first direction from the thermal print head, a ribbon drive motor coupled to the ribbon take-up and operable to rotate in a direction to move the ribbon downstream in the first direction with the movement of the substrate in the first downstream direction, the ribbon holder comprising a clutch operable to apply tension to the thermal ribbon to move the thermal ribbon in the second upstream direction with the movement of the substrate in the second upstream direction upon rotation of the platen in the second direction;

a cutter operable to sever a length of the substrate from the coil of substrate following printing of the substrate with an entire block of data, the cutter being located to sever the substrate at a location downstream in the print flow path from the thermal print head;

a printer controller comprising a first memory for storing a block of print data corresponding to an entire message to be printed on the length of the substrate to be severed from the coil of substrate following printing of the block of print data;

a print head controller comprising a print driver memory, coupled to the first memory and to the thermal print head, the print head memory receiving print data from the first memory and the print head controller controlling the printing by the thermal print head to print the substrate traveling in the first upstream direction with a message corresponding to the received print data;

the printer controller being operable to deliver the entire block of print data to the print head memory in the event the entire block of print data is smaller than the storage capacity of the print head memory;

the printer controller being operable to subdivide the block of print data into a plurality of data sub-blocks of print data at least if the block of print data exceeds the storage capacity of the print head memory; and, in the event the print data is subdivided into a plurality of print data sub-blocks, the printer controller being operable to control the substrate drive motor and the ribbon drive motor to cause movement of a first portion of the substrate in a first direction past the thermal print head, the print head controller being operable to control the thermal print head to print the first portion of the substrate passing the thermal print head in the first direction with a first sub-block of print data during a first printing act, and to interrupt the printing of the substrate by the thermal print head following printing of the first sub-block of print data, the printer controller being operable to control the substrate drive motor to reverse the direction of movement of the substrate such that a back distance section of the first portion of the substrate passes the thermal print head in the second downstream direction, and to thereafter move a second portion of the substrate that includes the back distance section in the first upstream direction past the thermal print head such that the back distance section of the substrate again passes the thermal print head in the first direction, the print head controller being operable to control the thermal print head to print the second portion of the substrate passing the thermal print head in the first downstream direction with a second sub-block of print data during a second printing act, the portion of the second sub-block of print data printed on the back distance section of the substrate during the second printing act corresponding to the print data printed on the back distance section of the substrate during the first printing act, the first printer controller and print head controller controlling the repeat of these acts until the entire block of print data is printed onto the substrate; and the printer controller also being coupled to the cutter to control the cutter to sever the substrate following printing of the entire block of print data onto the substrate.

14. A thermal printer according to claim 13 wherein the substrate drive motor and the ribbon drive motor are a simple motor.

15. A thermal printer according to claim 13 wherein the printer controller determines the length of the respective portions of the substrate to be a length of between four and six inches.

16. A thermal printer according to claim 13 wherein the printer controller determines the length of the respective portions of the substrate to be a variable length of between four and six inches.

17. A thermal printer according to claim 13 wherein the printer controller determines the length of the respective portions of the substrate to be of the same length between four and six inches.

18. A thermal printer according to claim 17 wherein the length of each sub-block of data corresponds to a page of data sent to the print head driver memory as a single print job, the page length being determined from the overall length of the message to be printed.

19. A thermal printer according to claim 13 wherein the printer controller controls the back distance to be a selected number of pixels of print data.

20. A thermal printer according to claim 19 wherein the pixel length of the back distance is from 15 to 20 pixels.

21. A thermal printer according to claim 13 wherein the printer controller determines the length of the respective portions of the substrate from a range of lengths.

22. A thermal printer according to claim 13 wherein each of the portions of the substrate are of the same length and wherein the printer selects the length of the portions of the substrate based on the overall length of the message to be printed by the block of print data.

* * * * *